US010195506B2

(12) United States Patent
Lammer et al.

(10) Patent No.: US 10,195,506 B2
(45) **Date of Patent: *Feb. 5, 2019**

(54) SYSTEM AND METHOD OF USING SHEAR THICKENING MATERIALS IN SPORTS PRODUCTS

(71) Applicant: Head Technology GmbH, Ltd., Kennelbach (AT)

(72) Inventors: Herfried Lammer, St. Veit (AT); Harald Rosenkranz, Lauterach (AT); Johan Kotze, St. Margrethen (CH); Ralf Schwenger, Weiler im Allgäu (DE)

(73) Assignees: HEAD TECHNOLOGY GMBH, Croydon (GB); DESIGN BLUE LIMITED, Croydon (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/997,089

(22) Filed: Jan. 15, 2016

(65) Prior Publication Data

US 2016/0367875 A1 Dec. 22, 2016

Related U.S. Application Data

(63) Continuation of application No. 13/972,648, filed on Aug. 21, 2013, now abandoned, which is a (Continued)

(51) Int. Cl.
*A63B 49/02* (2015.01)
*A63B 60/54* (2015.01)
(Continued)

(52) U.S. Cl.
CPC ..... *A63B 60/54* (2015.10); *A41D 13/015* (2013.01); *A42B 3/063* (2013.01); *A42B 3/08* (2013.01); *A43B 1/00* (2013.01); *A43B 7/32* (2013.01); *A43B 13/187* (2013.01); *A63B 5/12* (2013.01); *A63B 49/02* (2013.01); *A63B 49/022* (2015.10); *A63B 49/03* (2015.10); *A63B 49/08* (2013.01);
(Continued)

(58) Field of Classification Search
CPC ..... A63B 49/00; A63B 49/02; A63B 49/03; A63B 49/08; A63B 49/10; A63B 60/00; A63B 60/54; A63B 2049/0211; A63B 2060/0081; A63B 2209/02
See application file for complete search history.

(56) References Cited

U.S. PATENT DOCUMENTS 5,749,798 A * 5/1998 Kuebler ..... A63B 49/08 473/549
5,842,933 A * 12/1998 Lewis ..... A63B 53/14 473/300
(Continued)

*Primary Examiner* — Raleigh W Chiu
(74) *Attorney, Agent, or Firm* — Ryan T. Grace; Advent, LLP

(57) ABSTRACT

A sports product may include a support member and an impact region configured to impact an object. The impact region may be coupled to the support member. The sports product may also include a shear thickening material in at least one of the support member or the impact region. The shear thickening material may be configured to exhibit shear thickening behavior when an impact occurs between the impact region and the object.

16 Claims, 20 Drawing Sheets

Related U.S. Application Data continuation of application No. 13/332,162, filed on Dec. 20, 2011, now abandoned, which is a continuation of application No. 12/257,228, filed on Oct. 23, 2008, now Pat. No. 8,105,184.

(60) Provisional application No. 60/960,985, filed on Oct. 24, 2007.

(51) Int. Cl.

| | |
|---|---|
| ***A41D 13/015*** | (2006.01) |
| ***A43B 1/00*** | (2006.01) |
| ***A43B 13/18*** | (2006.01) |
| ***A63B 49/08*** | (2015.01) |
| ***A63B 49/10*** | (2015.01) |
| ***A63B 49/14*** | (2015.01) |
| ***A63B 53/04*** | (2015.01) |
| ***A63B 53/08*** | (2015.01) |
| ***A63B 53/10*** | (2015.01) |
| ***A63B 53/12*** | (2015.01) |
| ***A63B 53/14*** | (2015.01) |
| ***A63B 71/08*** | (2006.01) |
| ***A63B 71/10*** | (2006.01) |
| ***A63B 71/12*** | (2006.01) |
| ***A63B 5/12*** | (2006.01) |
| ***A63B 49/022*** | (2015.01) |
| ***A63B 60/10*** | (2015.01) |
| ***A63B 60/06*** | (2015.01) |
| ***A63B 49/03*** | (2015.01) |
| ***A63B 60/08*** | (2015.01) |
| ***A63B 60/14*** | (2015.01) |
| ***A63B 59/48*** | (2015.01) |
| ***A42B 3/06*** | (2006.01) |
| ***A42B 3/08*** | (2006.01) |
| ***A43B 7/32*** | (2006.01) |
| *A63B 60/00* | (2015.01) |
| *A63B 60/26* | (2015.01) |
| *A63B 102/08* | (2015.01) |
| *A63B 102/02* | (2015.01) |
| *A63B 102/04* | (2015.01) |

(52) U.S. Cl.

CPC ..... *A63B 49/10* (2013.01); *A63B 49/14* (2013.01); *A63B 53/04* (2013.01); *A63B 53/08* (2013.01); *A63B 53/10* (2013.01); *A63B 53/12* (2013.01); *A63B 53/14* (2013.01); *A63B 59/48* (2015.10); *A63B 60/00* (2015.10); *A63B 60/06* (2015.10); *A63B 60/08* (2015.10); *A63B 60/10* (2015.10); *A63B 60/14* (2015.10); *A63B 71/081* (2013.01); *A63B 71/10* (2013.01); *A63B 71/12* (2013.01); *A63B 53/047* (2013.01); *A63B 60/26* (2015.10); *A63B 2049/0211* (2013.01); *A63B 2060/002* (2015.10); *A63B 2060/0081* (2015.10); *A63B 2071/125* (2013.01); *A63B 2071/1233* (2013.01); *A63B 2071/1241* (2013.01); *A63B 2071/1258* (2013.01); *A63B 2071/1283* (2013.01); *A63B 2102/02* (2015.10); *A63B 2102/04* (2015.10); *A63B 2102/08* (2015.10); *A63B 2209/02* (2013.01); *Y10T 156/10* (2015.01)

(56) References Cited

U.S. PATENT DOCUMENTS

| | | | | |
|---|---|---|---|---|
| 5,944,617 | A * | 8/1999 | Falone | A63B 53/14 473/300 |
| 6,701,529 | B1 * | 3/2004 | Rhoades | C08L 83/14 2/2.5 |
| 8,105,184 | B2 * | 1/2012 | Lammer | A41D 13/015 473/521 |
| 2004/0048701 | A1 * | 3/2004 | Falone | B25G 1/01 473/568 |
| 2009/0191989 | A1 * | 7/2009 | Lammer | A41D 13/015 473/535 |

* cited by examiner

SYSTEM AND METHOD OF USING SHEAR THICKENING MATERIALS IN SPORTS PRODUCTS

This application is a continuation of U.S. patent application Ser. No. 13/972,648, filed Aug. 21, 2013, which is a continuation U.S. patent application Ser. No. 13/332,162, filed Dec. 20, 2011, now abandoned, which is a continuation of U.S. patent application Ser. No. 12/257,228, filed Oct. 23, 2008, now U.S. Pat. No. 8,105,184, which claims the benefit of U.S. Provisional Application No. 60/960,985, filed Oct. 24, 2007, the entireties of each of which are incorporated herein by reference.

TECHNICAL FIELD

The present disclosure relates to the use of shear thickening materials, and more particularly, to the use of shear thickening materials in sports products.

BACKGROUND

Sports products may include rackets, golf clubs, skis, snowboards, footwear, personal protection equipment, and/or other types of equipment known to those skilled in the art. Sports products may be designed to provide a user with a competitive advantage, enhance the user's comfort, or protect the user from being injured. A sports product's marketability may depend on how effective it is at providing such benefits. As such, manufacturers of sports products continually seek to improve the materials and designs used in the construction of their products.

While adding material to a sports product may improve the product's ability to absorb impacts, dampen vibrations, or perform other advantageous functions, it may also add bulk and weight to the product. The added bulk and weight may negate the advantages by increasing a user's discomfort, and/or hindering a user's movement or performance. Thus, sports products are often times constructed of lightweight, thin materials. However, if the materials are too thin or weak, they may lose their effectiveness, or may be easily damaged. A balance must be struck between these considerations. Further complicating matters is that in some instances, the properties that make materials desirable under one set of conditions, may make the same materials undesirable under another set of conditions.

The present disclosure addresses at least some of the problems described above and other problems in existing technology.

SUMMARY

In accordance with an aspect of the disclosure, a racket may include a head region, a striking region, a throat region, a shaft region, or a handle region. The racket may also include a shear thickening material in at least one of the head region, striking region, throat region, shaft region, or handle region. The shear thickening material may be configured to exhibit shear thickening behavior when an impact occurs between the racket and an object.

In accordance with another aspect of the disclosure, a sports product may include a support member and an impact region configured to impact an object. The impact region may be coupled to the support member. The sports product may also include a shear thickening material in at least one of the support member or the impact region, the shear thickening material being configured to exhibit shear thickening behavior when an impact occurs between the impact region and the object.

In accordance with another aspect of the disclosure, a method for manufacturing a sports product may include manufacturing a first layer of material. The method may also include manufacturing a second layer of material. The method may further include depositing a shear thickening material between the first layer of material and the second layer of material. The shear thickening material may provide a first level of flexibility when a first type of impact occurs between at least one of the first layer of material and the second layer of material, and an object. The shear thickening material may provide a second level of flexibility when a second type of impact occurs between at least one of the first layer of material and the second layer of material, and the object.

Additional objects and advantages of the disclosure will be set forth in part in the description which follows, and in part will be obvious from the description, or may be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

The accompanying drawings, which are incorporated in and constitute a part of this specification, illustrate several embodiments of the disclosure and together with the description, serve to explain the principles of the disclosure.

DESCRIPTION OF THE EMBODIMENTS

Figure 1:
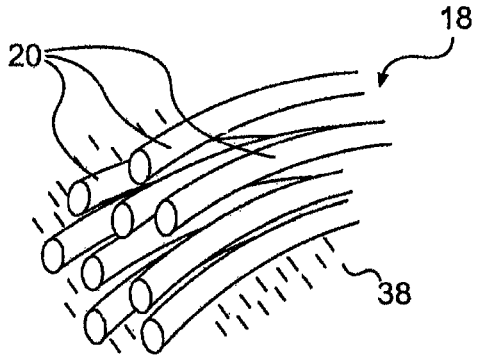
FIG. 1 is an enlarged view of a composite material according to an aspect of the present disclosure.
Figure 2:
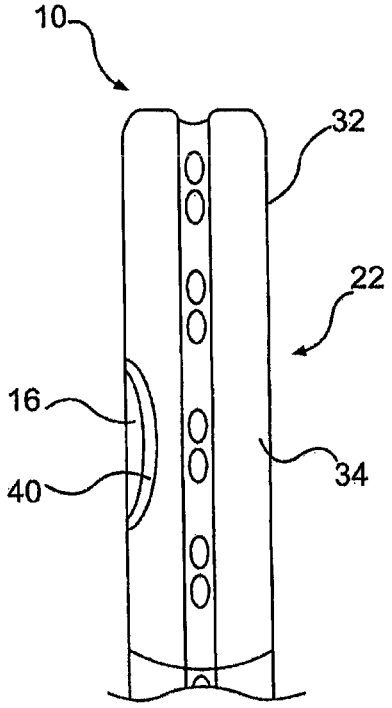
FIG. 2 is a partial side view of a racket according to another aspect of the present disclosure.
Figure 3:
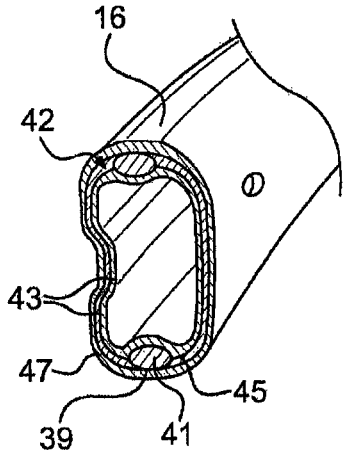
FIG. 3 is a partial section view of the racket of FIG. 2 according to yet another aspect of the present disclosure.

Reference will now be made in detail to exemplary embodiments of the disclosure, examples of which are illustrated in the accompanying drawings. Wherever possible, the same reference numbers will be used throughout the drawings to refer to the same or like parts.

Shear thickening or dilatant materials have properties that distinguish them from other materials. For example, when shear thickening materials are subjected to an increasing rate of shear deformation, they undergo an increase in viscosity and/or rigidity. For example, a shear thickening material may behave like a low viscosity fluid when not subjected to shear deformation or subjected to a low rate of shear deformation, but may behave like a highly viscous fluid when subjected to a high rate of shear deformation. Another shear thickening material may behave like a fluid when not subjected to shear deformation or subjected to a low rate of shear deformation, but may behave like a quasi-solid or solid when subjected to a high rate of shear deformation. Yet another a shear thickening material may behave like a quasi-solid or flexible solid when not subjected to shear deformation or subjected to a low rate of shear deformation, but may behave like a rigid solid when subjected to a high rate of shear deformation.

A shear thickening material's starting point (i.e., its normal or at rest condition) and ending point (i.e., its condition when subjected to a high rate of shear deformation) may define endpoints of a region, the region covering a portion of a spectrum. One end of the spectrum may be characterized as "fluidity," while the opposite end may be characterized as "rigidity." By adjusting the forces acting on the shear thickening material, or adjusting the types and/or quantities of ingredients in the shear thickening material, its region may be shrunken, expanded, and/or shifted towards one end of the spectrum or the other. The introduction of a high rate of shear deformation will drive the shear thickening material in the direction of rigidity, while removal of the shear deformation will drive the shear thickening material toward fluidity.

The behavior of shear thickening materials may also be time dependent. When a shear force is applied to a shear thickening material over a long timescale, the shear thickening material may not move in the direction of rigidity. If, however, the shear force is applied to the shear thickening material over a short timescale, the shear thickening material will move in the direction of rigidity. The timescale limit under which the shear thickening material will exhibit shear thickening behavior may depend on a number of factors, such as the type of shear thickening material involved, and the characteristics of the force applied to the shear thickening material.

The behavior of shear thickening materials may be caused by at least one of the following mechanisms. One mechanism is shear induced ordering, where the alignment of particles in a medium may increase as a shearing force is applied. The more aligned the particles become, the more they behave like a solid material. Additionally or alternatively, the shear thickening behavior may be caused by dilation, or a change in volume, of one or more ingredients in the shear thickening material. For example, a shear thickening material may include powder molecules whose volume may expand as a shearing force is applied. The expanding volume may move the shear thickening material in the direction of rigidity. In some cases, the shear thickening behavior of a shear thickening material may be caused by attraction between molecules, where the attraction increases as a shearing force is applied, thus driving the shear thickening material toward rigidity. The shear thickening behavior may also be caused by friction, where friction between components of the shear thickening material increase as shearing force is applied. The increased friction may inhibit free movement of the components past each other, driving the shear thickening material toward rigidity. The shear thickening behavior may also be caused by shear forces overcoming repulsive forces between particles in a material, causing the particles to clump. The clumping may drive the shear thickening material toward rigidity.

Removal of the shearing force may have the opposite effect, that is, removal may precipitate the shear thickening material's movement in the direction of fluidity. It should be understood that the above list of interactions and mechanisms is not intended to be exhaustive, and that shear thickening behavior may be the result of any phenomenon or interaction, or combination of phenomena or interactions, as would be apparent to one skilled in the art.

Some common examples of shear thickening materials include a mixture of corn starch and water (often times referred to as "oobleck") that may become more difficult to stir as the stirring rate increases, and putty material that may be easily deformed when slow pressure is applied, but may resist deformation when thrown against a surface.

Various categories of shear thickening materials will now be described. It should be understood that this list is not intended to be exhaustive, and any suitable types of shear thickening material are contemplated for use in the disclosed embodiments.

One category of shear thickening materials includes shear thickening fluids. A shear thickening fluid may possess the characteristics of a fluid until it encounters a shear force, whereupon the shear thickening fluid will thicken (e.g., move toward rigidity), and behave more like a higher viscosity fluid, quasi-solid, or solid. The shear force may be supplied by direct or indirect impact of an object against the shear thickening fluid, or any other suitable form of agitation. When the shear force is removed, the shear thickening fluid will return to its previous state.

The shear thickening fluid may be a colloid, made of particles suspended in a liquid medium. Under normal conditions (i.e., where the shear thickening fluid is undisturbed by a shear force, or acted on by a slowly applied shear force), the particles will repel each other slightly, such that the particles may float interspersed throughout the liquid medium without clumping together or settling. The energy of a sudden impact will overwhelm the repulsive forces between the particles, causing the particles to clump together. The clumping may increase the viscosity of the shear thickening fluid. When the energy from the impact dissipates, the particles will return to repelling one another again, causing the clumps to fall apart. As such, the viscosity may return to the level that existed prior to the impact. Additionally or alternatively, the liquid may exhibit shear thickening behavior.

The particles may include, for example, silica particles. The liquid medium may include, for example, polyethylene glycol. It should be understood, however, that any suitable particles and fluid medium may be used. Shear thickening fluids may be used to make films, resins, finishes, and coatings that exhibit shear thickening behavior. Methods used to make films, finishes, and coatings using fluids are well known in the art, and no further description will be provided here.

Another category of shear thickening materials includes shear thickening gels. A shear thickening gel may have the characteristics of a high viscosity fluid, quasi-solid, or any composition in between. The composition and properties of the shear thickening gel may be similar to those of the shear thickening fluid. However, under similar conditions, the shear thickening gel may have a higher viscosity or rigidity than the shear thickening fluid.

Shear thickening gels may possess jelly-like qualities, or qualities associated with putties or clays. Under normal conditions, shear thickening gels will have fluid characteristics, and may be deformed with the application of little or no force. However, when subjected to the energy of a sudden impact, shear thickening gels will move toward rigidity, and their ability to resist deformation will improve.

A shear thickening gel may include the same ingredients as a shear thickening fluid, but may exist in gel form due to environmental conditions. Additionally or alternatively, the shear thickening gel may include an ingredient that causes the fluid medium to become gelatinous. The mechanism behind the shear thickening behavior of shear thickening gels may be similar to those of other categories of shear thickening materials.

Another category of shear thickening materials includes encapsulated fluids or gels. These may include containers filled with shear thickening fluids or gels. A container of shear thickening fluid or gel may include a structure configured to store the fluid or gel. The container may include one or more walls made of either flexible or rigid material. The container may be configured to receive impacts or vibrations, and to transmit them to the fluid or gel. The impacts or vibrations will cause the fluid or gel to become more viscous or even rigid, imparting the overall container with greater rigidity. Shear thickening materials may also be used in the construction of the container walls themselves.

Another category of shear thickening materials includes shear thickening foams. A shear thickening foam may be formed by trapping gas bubbles, produced using physical or chemical means, in a shear thickening fluid or gel. The material may then be solidified. The interactions and mechanisms behind the shear thickening behavior of a shear thickening foam may be similar to those of other shear thickening materials. When the shear thickening foam is subjected to the energy of a sudden impact, its rigidity will increase. Before and after the impact, under normal conditions, the shear thickening foam will be relatively flexible.

Another category of shear thickening materials includes shear thickening solids. A shear thickening solid may be formed by solidifying a shear thickening fluid or gel, or otherwise incorporating shear thickening material into a solid object. Shear thickening solids can be formed by processes including, for example, extrusion or injection molding. When the shear thickening solid is subjected to the energy of a sudden impact, its rigidity will increase. Under normal conditions, however, the solid will be more flexible. The interactions and mechanisms by which the rigidity of a shear thickening solid increases may be similar to those of other shear thickening materials.

Another category of shear thickening materials includes shear thickening filaments. A shear thickening filament may be formed by any suitable processes, or combination of processes, including, for example, injection molding, extrusion, or spinning out of a melt. The shear thickening filament may exhibit the characteristics of a shear thickening solid.

Another category of shear thickening materials includes impregnated fibers. An impregnated fiber may include, for example, a fiber or yarn that has absorbed, and/or is coated with, a shear thickening material. The fiber may include a high strength polymeric fiber. The shear thickening material may be a fluid, and may retain its fluid characteristics after impregnation. This may help to ensure that the impregnated fiber will remain flexible, while endowing the fiber with shear thickening properties.

Another category of shear thickening materials includes impregnated fiber reinforced materials. An impregnated fiber reinforced material may include, for example, a fabric that has absorbed, and/or is coated with, a shear thickening material. Additionally or alternatively, the impregnated fiber reinforced material may include previously impregnated fibers woven together to form a fabric. It is also contemplated that the impregnated fiber reinforced material may include a fabric made by weaving together shear thickening filaments and/or impregnated fibers. It is further contemplated that the fabric or fibers may be set into another medium to reinforce that medium. It is also contemplated that shear thickening materials may be mixed in with the medium to impart shear thickening properties to the medium.

The impregnated fiber reinforced material may exhibit shear thickening behaviors, similar those described above with respect to the other categories of shear thickening materials. For example, the coefficient of friction between the fibers, and/or between the fibers and the medium, will increase during an impact event, causing the fibers and/or medium to become more rigid. It is further contemplated that the fibers may form a substrate that, when a shear thickening material permeates the fibers, holds particles of the shear thickening material in place. When an object suddenly strikes the impregnated fiber reinforced material, the shear thickening material will immediately thicken or harden, imparting its hardness to the overall construction. The flexibility of the overall construction will return upon removal of the force.

Another category of shear thickening materials includes shear thickening composites. A shear thickening composite may include, for example, a solid foamed synthetic polymer. The solid foamed synthetic polymer may include an elastic, and/or an elastomeric matrix. The elastomeric matrix may retain its own boundaries without need of a container. The composite may also include a polymer-based dilatant different from the solid foamed synthetic polymer. The polymer-based dilatant may be distributed through the matrix and incorporated therein during manufacture. The composite may also include a fluid distributed through the matrix. The combination of the matrix, dilatant, and fluid may be selected such that the composite may be resiliently compressible. (i.e., display resistance to compressive set), and preferably also flexible.

Another shear thickening composite may include a solid, closed cell foam matrix and a polymer-based dilatant, different from the matrix, distributed through the matrix. The composite may also include a fluid distributed through the matrix. The combination of matrix, dilatant, and fluid may be selected such that the composite may be resiliently compressible.

In either of the shear thickening composites described above, any suitable solid materials may be used as the matrix, including, for example, elastomers. This may include natural elastomers, as well as synthetic elastomers, including synthetic thermoplastic elastomers. These may include elastomeric polyurethanes, silicone rubbers, and ethylene-propylene rubbers. Any polymer-based dilatant that may be incorporated into the matrix may be used in the shear thickening composites. The dilatant may be selected from silicone polymer-based materials, such as borated silicone polymers. The dilatant may be combined with other components in addition to the components providing the dilatancy, including, for example, fillers, plasticisers, colorants, lubricants and thinners. The fillers may be particulates (including microspheres), fibrous, or a mixture of the two. It is contemplated that a borated siloxane-based material may be used as a dilatant.

Another category of shear thickening materials includes shear thickening layers. A shear thickening layer may include a layer of material formed from one of, or a combination of, the above-categories of shear thickening materials. The shear thickening layer may be combined with layers having other properties, such that the combined layers may exhibit some form of shear thickening behavior as a result.

In the description of sports products that follows, use of the term "shear thickening materials" is meant to cover all categories of shear thickening materials and combinations of shear thickening materials known to those skilled in the art.

Rackets may be used in a variety of sports. For example, rackets may be used to play tennis, racketball, squash, badminton, paddle ball, and/or other known racket sports. A racket used for one sport may differ structurally from a racket used in another sport. Even rackets used for the same sport may have differences in structure that may provide users with different benefits or advantages. Exemplary rackets 10, 12, and 14, whose features are shown in FIGS. 2-20, are described below. The descriptions of rackets 10, 12, and 14 below may be applicable to any known rackets, including, for example, tennis rackets, racketball rackets, squash rackets, badminton rackets, and/or paddle ball paddles. Exemplary rackets are also shown in PCT/EP2007/000929, and U.S. Pat. Nos. 7,077,767 B2 and 7,140,984 B2, the disclosures of all of which are incorporated herein by reference.

Rackets 10 and 12, shown in FIGS. 2-14 and 17, may represent string-type rackets, such as those used for tennis, racketball, badminton, and squash. Racket 14, shown in FIGS. 18-20, may represent paddle-type rackets, such as those used for paddle tennis. The description below of any one of rackets 10, 12, and 14 may also apply to the others of rackets 10, 12, and 14.

Racket 10 may include a frame 16. Frame 16 may be constructed of a composite material by, for example, placing a core, including a tube having one or more layers 43 of woven reinforcing fibers, in a mold (not shown) defining the shape of frame 16, closing the mold, and injecting an epoxy material 38 into the mold around the core. The tube may be formed by, for example, winding one or more substantially planar sheets of material into tubular form to form layers 43 shown in FIG. 3. A planar sheet of shear thickening material may be at least partially enclosed between the planar sheets forming layers 43 prior to winding, and may form a shear thickening layer 45 after winding.

The reinforcing fibers may be carbon fibers, boron fibers, glass fibers, silicon carbide fibers, ceramic fibers, or aramid fibers of the kind available under the trade name Kevlar, or any combination of these materials. An enlarged view of an exemplary composite material 18, with its reinforcing fibers 20 and epoxy material 38 are shown in FIG. 1.

Frame 16 may include a number of regions, including, for example, a head region 22 (shown in FIGS. 2-6), a striking region 24 (shown in FIGS. 4, 5, and 17), a throat region 26 (shown in FIGS. 5-9), a shaft region. 28 (shown in FIGS. 7-9), and a handle region 30 (shown in FIGS. 7, 9, and 11-14). Each of the regions is described below.

Head region 22 may include a head 32, a bumperguard 34, and a hitting surface 36. Head 32 may include the portion of frame 16 surrounding hitting surface 36. Head 32 may be composed, at least partially, of composite material 18, and may include shear thickening materials. For example, reinforcing fibers 20 may be impregnated with shear thickening materials. Additionally or alternatively, shear thickening materials may be mixed in with epoxy material 38. Shear thickening materials may also be provided in an interior of head 32, such as in a wall 42 of head 32 (as shown in FIG.

3). For example, shear thickening layer 45 may be at least partially enclosed by other layers (e.g., epoxy material 38 and/or one or more layers 43) used to form wall 42. Additionally or alternatively, a cavity 39 may be formed in wall 42 that may receive shear thickening materials 41. Cavity 39 may be formed using a mold, as would be apparent to one skilled in the art. Additionally or alternatively, cavity may be formed by material removal processes (e.g., cutting or drilling).

Figure 4:
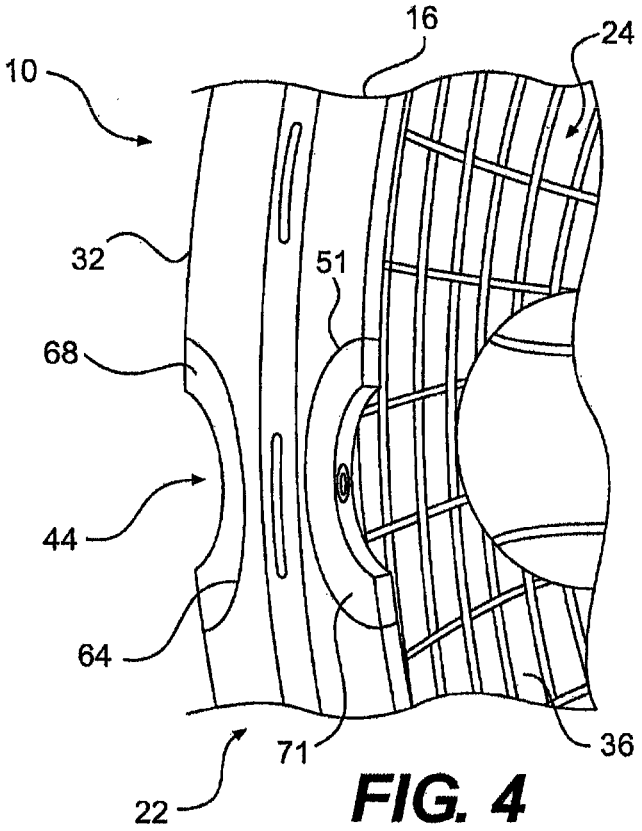
FIG. 4 is a partial perspective view of the racket of FIG. 2 according to yet another aspect of the present disclosure.

Shear thickening materials 68 and 71 may also be provided on an exterior of head 32, as shown in FIG. 4. The exterior may include a pair of trough shaped concavities or depressions 51 and 64, formed in head 32, between about two o'clock and four o'clock, in particular at three o'clock; and/or between about eight o'clock and ten o'clock, in particular at nine o'clock. Depressions 51 and 64 may be molded into head 32 or may be formed by material removal processes. Because of depressions 51 and 64, the bending resistance moment of head 32 may be lower than in areas of head 32 having no depressions, and thus, depressions 51 and 64 may form a joint or flexpoint 44.

Flexpoint 44 may provide advantageous ball control characteristics. Upon impact with a ball, head 32 may flex or deform at flexpoint 44. By placing shear thickening materials 68 and 71 at flexpoint 44, the stiffness/flexibility of head 32 may vary in accordance with the viscosity or rigidity of shear thickening materials 68 and 71. Shear thickening materials 68 and 71 may be inserts configured to seal depressions 51 and 64. When shear thickening materials 68 and 71 stiffen upon impact with a ball, flexpoint 44 may also stiffen. A stiffer head or frame may bend less, thus offering more power. When shear thickening materials 68 and 71 return to their rest state, flexpoint 44 may regain its normal flexibility. A flexible head or frame may bend more, resulting in energy loss and less power, but more control of the ball and a softer "feel."

Shear thickening materials may also be positioned at any other regions of head 32 that experience bending stress and/or shear stress on impact. Preferably, the shear thickening materials may be positioned at those regions of head 32 that experience maximum bending stress and/or shear stress on impact. Additionally or alternatively, shear thickening materials may be positioned in regions of head 32 containing antinodes, where head 32 experiences maximum vibrational displacement after an impact.

Bumperguard 34 may surround at least a portion of head 32. Bumperguard may help protect head 32 from impacts. Bumperguard 34 may include shear thickening materials that may help absorb the impacts, thus protecting head 32 from damage, and dampening vibrations caused by the impacts before they are transmitted through frame 16 to the user.

Shear thickening materials may be mixed in with polymer materials used in the construction of bumperguard 34. A layer 40 or layers of shear thickening material (shown in the cut-out in FIG. 2) may be provided between bumperguard 34 and head 32. Additionally or alternatively, bumperguard 34 may include adhesive tape, adhered around head 32, that may be reinforced with shear thickening materials.

Hitting surface 36 may include strings, such as those used in tennis, racketball, squash, and badminton rackets. Hitting surface 36 may also include a paddle face 50, shown in FIGS. 18-20, used in paddle tennis paddles.

Figure 17:
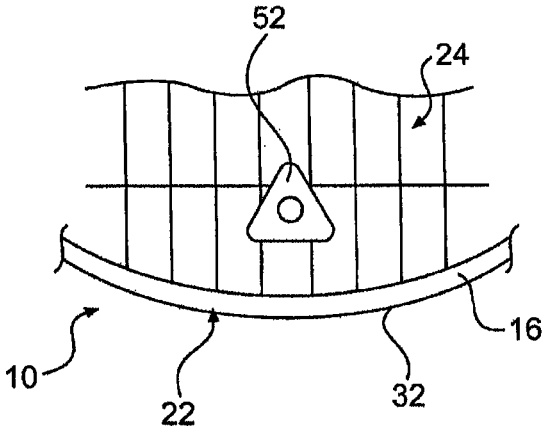
FIG. 17 is a partial front view of the racket of FIG. 2 according to yet another aspect of the present disclosure.

The strings may include one or more materials, including, for example, gut or synthetic materials (e.g., nylon, polyamide, and other polymers). The materials used in the strings can change the performance of a racket, and thus, the composition of the strings may be varied to create variations in terms of playability, durability, and "feel," among other considerations. In some cases, a vibration dampening device 52 may be placed on the strings, as shown in FIG. 17. Vibration dampening device 52 may be constructed of, or may contain, shear thickening materials. In one embodiment, portions of vibration dampening device 52 directly contacting the strings may include the shear thickening materials.

The strings may be of a monofilament or multifilament type. Monofilament strings, like string 46 in FIG. 15, may include a single, thick strand of material. The single, thick strand may be made, at least partially, of shear thickening materials. Additionally or alternatively, the thick strand may be impregnated with shear thickening materials.

Figure 16:
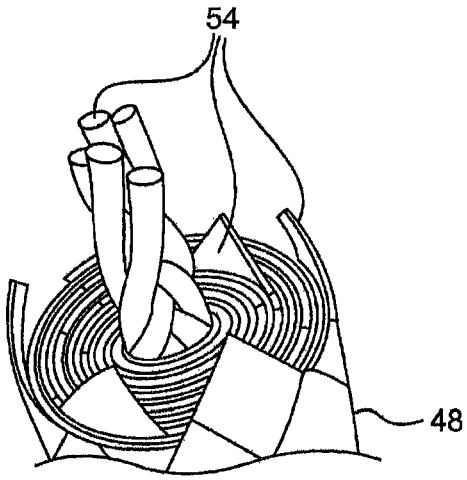
FIG. 16 is a partial perspective view of a string according to yet another aspect of the present disclosure.

A multifilament string 48 is shown in FIG. 16. Multifilament string 48 may be constructed of many smaller strands 54 wound, woven, or otherwise joined together to form a larger strand of material. Smaller strands 54 may include filaments, flat ribbon-like pieces, and/or any other suitable strand types known to those skilled in the art. One or more of smaller strands 54, such as a filament 55, may include shear thickening materials. Multifilament string 48 may also be impregnated with shear thickening materials.

Figure 18:
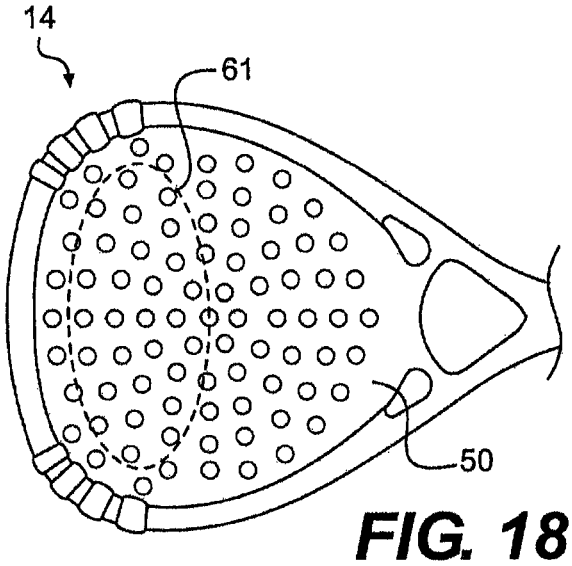
FIG. 18 is a partial front view of a racket according to yet another aspect of the present disclosure.
Figure 19:
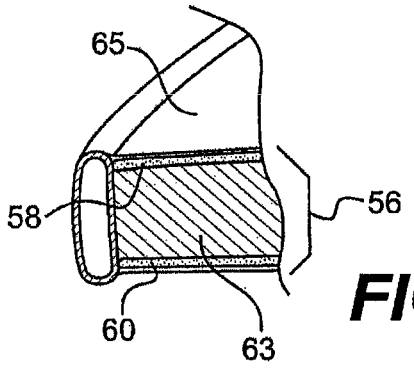
FIG. 19 is a partial section view of the racket of FIG. 18 according to yet another aspect of the present disclosure.
Figure 20:
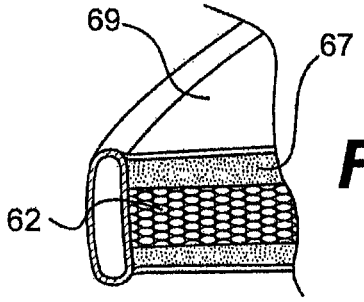
FIG. 20 is a partial section view of an alternative embodiment of the racket of FIG. 18 according to yet another aspect of the present disclosure.

Another hitting surface, paddle face 50 of FIG. 18, may be textured and/or perforated. Paddle face 50 may include one or more layers 56 in its construction, including, for example, layers 58, 60, 62, 63, 65, 67, and a 69. One or more of those layers 56 may include shear thickening materials. For example, as shown in FIGS. 19 and 20, layers 58, 60, and 62 may be shear thickening layers. It is also contemplated that shear thickening materials may be used in a hitting region 61 or sweet spot on paddle face 50.

Figure 5:
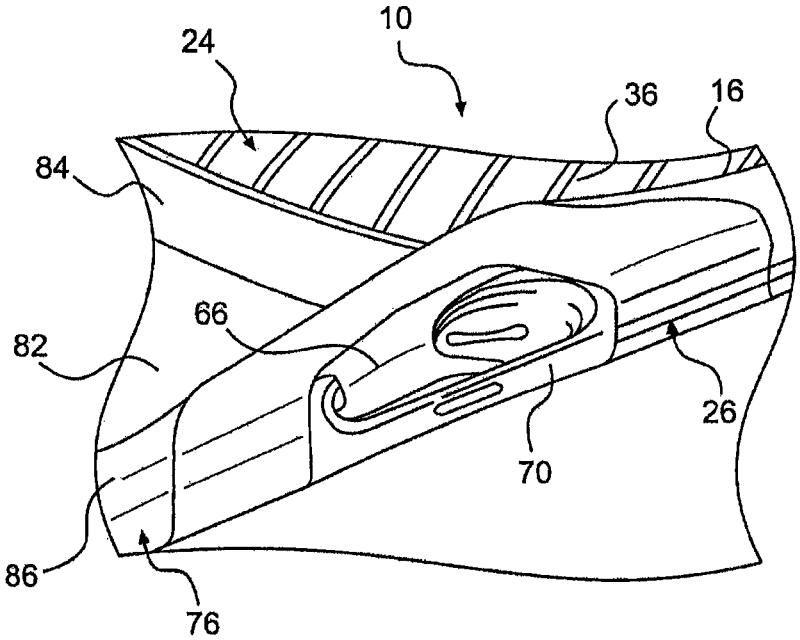
FIG. 5 is a partial perspective view of the racket of FIG. 2 according to yet another aspect of the present disclosure.
Figure 6:
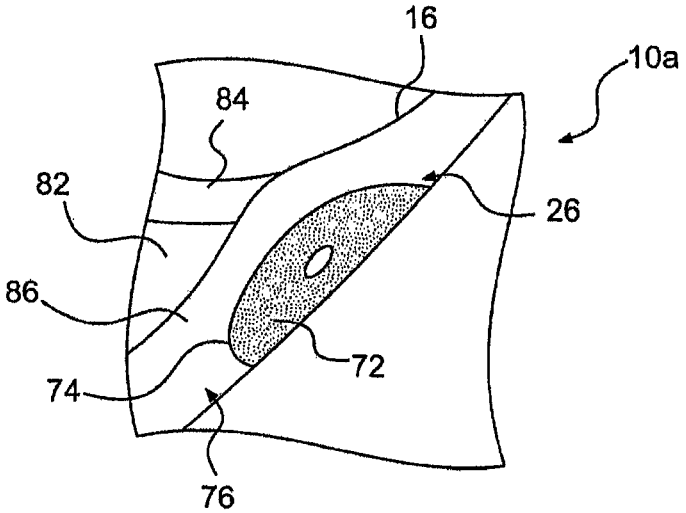
FIG. 6 is a partial perspective view of an alternative embodiment of the racket of FIG. 2 according to yet another aspect of the present disclosure.

Throat region 26 may include the portion of frame 16 between head region 22 and shaft region 28. Throat region 26 may be constructed of the same or similar materials as head 32. For example, throat region 26 may be constructed of composite material 18. Throat region 26 may also include concavities 66 and 74 that may be at least partially filled by shear thickening material 70 and 72, as shown in FIG. 5 and racket 10*a* of FIG. 6, which represents an alternative embodiment.

Shear thickening materials 70 and 72 may be positioned in areas of throat region 26 that may experience bending stress and/or shear stress upon impact. Preferably, shear thickening materials 70 and 72 may be positioned in areas of throat region 26 that may experience maximum bending stress and/or shear stress upon impact. Additionally or alternatively, shear thickening materials 70 and 72 may be positioned at antinodes, where throat region 26 may experience maximum vibrational displacement after an impact.

Figure 8:
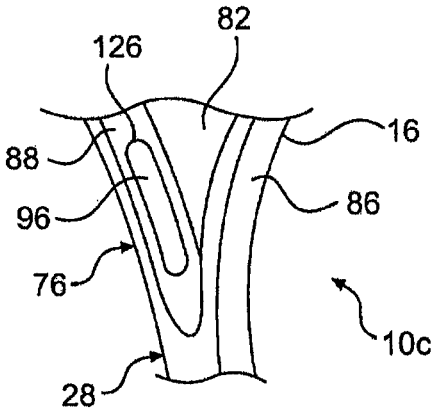
FIG. 8 is a partial perspective view of an alternative embodiment of the racket of FIG. 2 according to yet another aspect of the present disclosure.
Figure 9:
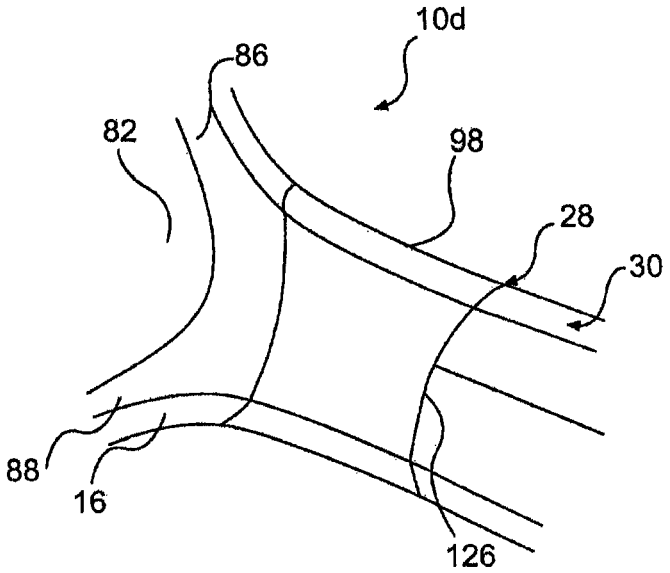
FIG. 9 is a partial perspective view of an alternative embodiment of the racket of FIG. 2 according to yet another aspect of the present disclosure.
Figure 10:
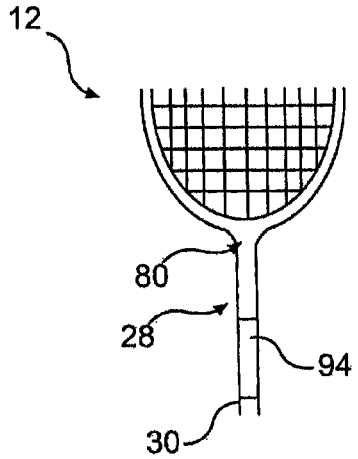
FIG. 10 is a partial front view of a racket according to an aspect of the present disclosure.

Additionally, throat region 26 may include a throat 76. Throat 76 may be an open throat 78, as shown in the embodiments of FIGS. 5-9, or a closed throat 80, as shown in the embodiment of FIG. 10.

Open throat 78 may include an opening 82 surrounded by portions 84, 86, and 88 of frame 16. One or more of portions 84, 86, and 88 may include a discontinuity or cavity 126 in which shear thickening materials 96 may be inserted, as shown in FIG. 8. Cavity 126 may be formed during molding of frame 16 by, for example, providing a protrusion in a mold (not shown) having a shape complementary to that of cavity 126. Additionally or alternatively, cavity 126 may be formed by material removal processes. Cavity 126 may be formed in surfaces of portions 84, 86, and 88 surrounding opening 82, and/or on surfaces of portions 84, 86, and 88 facing away from opening 82.

Figure 7:
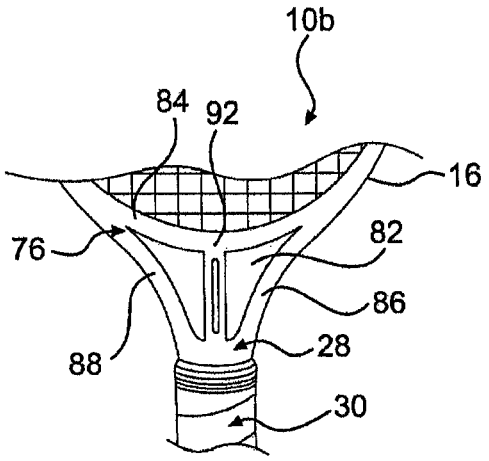
FIG. 7 is a partial front view of an alternative embodiment of the racket of FIG. 2 according to yet another aspect of the present disclosure.

In the embodiment of FIG. 7, open throat 78 may include a central portion 90 extending through opening 82, thus dividing opening 82 into two halves. Central portion 90 may include shear thickening materials 92, similar to the other regions of frame 16.

Shaft region 28 may include the portion of frame 16 between throat region 26 and handle region 30. Shaft region 28 may include a similar construction as the other regions of frame 16. Shear thickening materials 94 and 98 may be positioned in shaft region 28 proximate where shaft region 28 meets handle region 30, as shown in FIGS. 9 and 10. Shear thickening materials 94 and 98 may be, for example, an annular ring, and may surround a channel-shaped gap extending at least partially around shaft region 28. Shear thickening materials 94 and 98 may be placed where bending stress and/or shear stress may be experienced upon impact. Preferably, shear thickening materials 94 and 98 may be positioned in shaft region 28 where maximum bending stress and/or shear stress may be experienced upon impact. Additionally or alternatively, shear thickening materials 94 and 98 may be positioned at an antinode. The antinode may include a region experiencing maximum vibration displacement after an impact.

Figure 11:
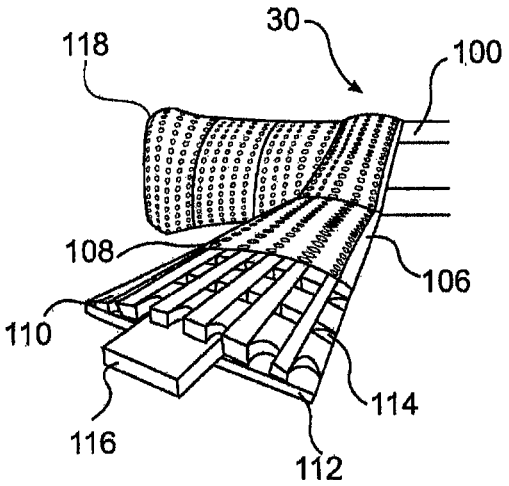
FIG. 11 is a partial perspective view of the racket of FIG. 2 according to yet another aspect of the present disclosure.

Handle region 30, shown in FIG. 11, may include a portion of frame 16 opposite head region 22. As such, handle region 30 may be constructed of materials used in other regions of frame 16, and may also include shear thickening materials.

Figure 12:
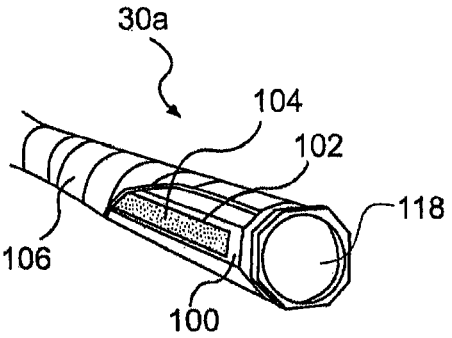
FIG. 12 is a partial perspective view of an alternative embodiment of the racket of FIG. 2 according to yet another aspect of the present disclosure.
Figure 13:
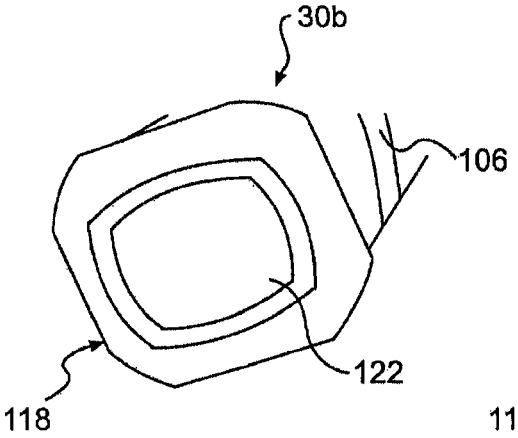
FIG. 13 is a partial perspective view of an alternative embodiment of the racket of FIG. 2 according to yet another aspect of the present disclosure.
Figure 14:
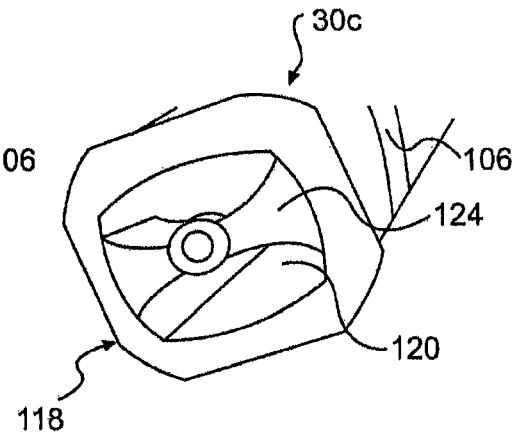
FIG. 14 is a partial perspective view of an alternative embodiment of the racket of FIG. 2 according to yet another aspect of the present disclosure.
Figure 15:
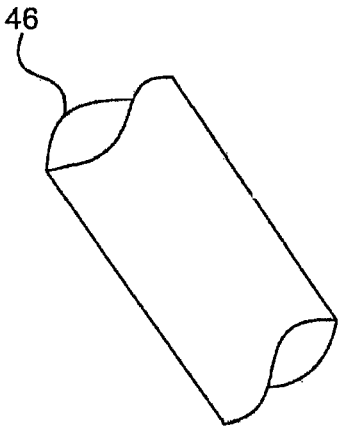
FIG. 15 is a partial perspective view of a string according to yet another aspect of the present disclosure.

Handle region 30 may be at least partially surrounded by a grip 100. Grip 100 may include a polymer material surrounding handle region 30, providing handle region 30 with a polygonal outer surface. The material used to form grip 100 may include shear thickening materials. Additionally or alternatively, grip 100 may include composite material 18. A handle region 30*a*, representing an alternative embodiment, is shown in FIG. 12. As shown, it is contemplated that grip 100 may include a discontinuity or space 102 into which an inlay 104 of shear thickening materials may be inserted.

A grip tape 106 may be wound around grip 100. Grip tape 106 may be configured to provide tack (adhesive force), moisture wicking, and cushioning. Grip tape 106 may include a lining layer 108, a polyurethane layer 110, an adhesive layer 112, and/or any other layers known to those skilled in the art. One or more of layers 108, 110, and 112 may include shear thickening materials. Additionally or alternatively, shear thickening materials may fill spaces or discontinuities 114 in and/or between layers 108, 110, and 112.

It is also contemplated that a layer 116 of shear thickening materials may be secured between grip 100 and grip tape 106. Layer 116 may be a strip wrapped around grip 100 in a manner similar to grip tape 106. Layer 116 may include adhesive on one or more of its surfaces to help it adhere to grip 100 and/or grip tape 106.

Handle region 30 may also include a butt end 118. Handle regions 30*b* and 30*c*, representing alternative embodiments of handle region 30, show alternative embodiments of butt end 18, depicted in FIGS. 13 and 14. In each of handle regions 30*b* and 30*c*, a recess 120 may be formed by grip 100 and/or frame 16 at butt end 118. Shear thickening materials 122 and 124 may be used to fill, at least partially, recess 120.

Rackets 10*e*, 10*f*, 10*g*, and 10*h* in FIGS. 30-38 show additional embodiments. It is contemplated that features shown and described in the description of rackets 10, 10*a*, 10*b*, 10*c*, and 10*d* may also be provided on rackets 10*e*, 10*f*, 10*g*, and 10*h*, and vice-versa.

Figure 30:
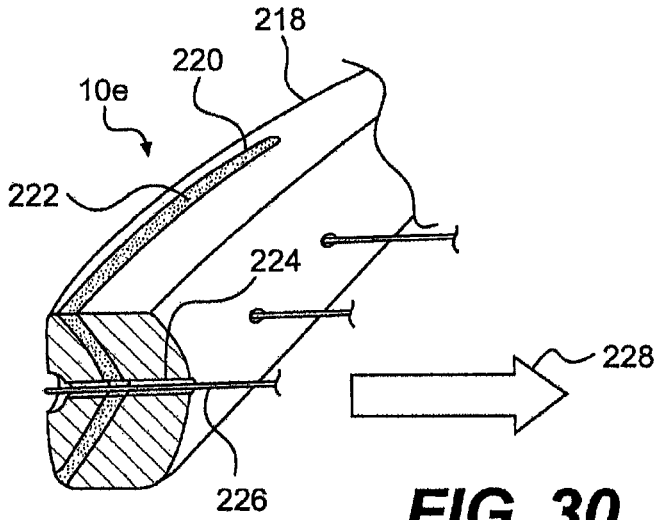
FIG. 30 is a partial section view of a racket according to yet another aspect of the present disclosure.
Figure 31:
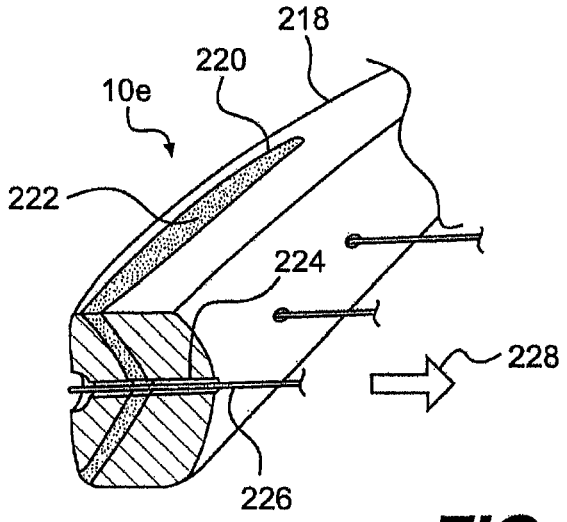
FIG. 31 is the partial section view of the racket of FIG. 30 according to yet another aspect of the present disclosure.

Racket 100, shown in FIGS. 30 and 31, may include a frame 218. A v-shaped slot or cutout 220 may be provided in frame 218. Slot 220 may be at least partially filled by shear thickening materials 222. Shear thickening materials 222 may include, for example, a shear thickening composite including a dilatant foam. Shear thickening materials 222 may be bonded to the surfaces of frame 218 forming slot 220 using adhesive, mechanical connection, encapsulation, and/or any other means known in the art. With this arrangement, shear thickening materials 222 divides at least a portion of frame 218 into a radially inner layer that occupies a radially inner position with respect to shear thickening material 222, and a radially outer layer that occupies a radially outer position with respect to shear thickening materials 222.

Frame 218 is shown with a string hole 224 and a string 226. String 226 may be coupled to the radially outer layer of frame 218. Under normal tensile forces acting on string 226, represented by arrow 228 of FIG. 31, shear thickening materials 222 may remain soft. Accordingly, the radially inner and outer layers of frame 218 may move relative to one another. The relative movement may include a rotational component, with the radially outer layer of frame 218 rotating towards the radially inner layer of frame 218. It should be understood that shear movement between the radially inner and outer layers of frame 218 may also occur.

On the other hand, when tensile forces acting on string 226 increase, the radially outer layer of frame 218 may be pulled toward the radially inner layer of frame 218. Increased tensile forces are represented by arrow 228 in FIG. 30. The movement of the radially outer layer of frame 218 relative to the radially inner layer of frame 218 may produce compressive forces on shear thickening materials 222, causing shear thickening materials 222 to stiffen. When shear thickening materials 222 stiffen, shear movement or relative rotation of the radially outer layer of frame 218 with respect to the radially inner layer of frame 218 may be reduced or impeded.

By controlling the degree of relative movement between the inner and outer layers of frame 218, racket 10*e* may provide a user with enhanced performance. For example, when shear thickening materials 222 are soft, frame 218 may be more flexible. That flexibility may give racket 10*e* a softer feel, providing the user with greater control over the ball for soft or touch shots. When shear thickening materials 22 stiffen, frame 218 may become stiffer. The stiffness may give racket 10*e* a harder feel, providing the user with the ability to strike a ball with greater force.

Figure 32:
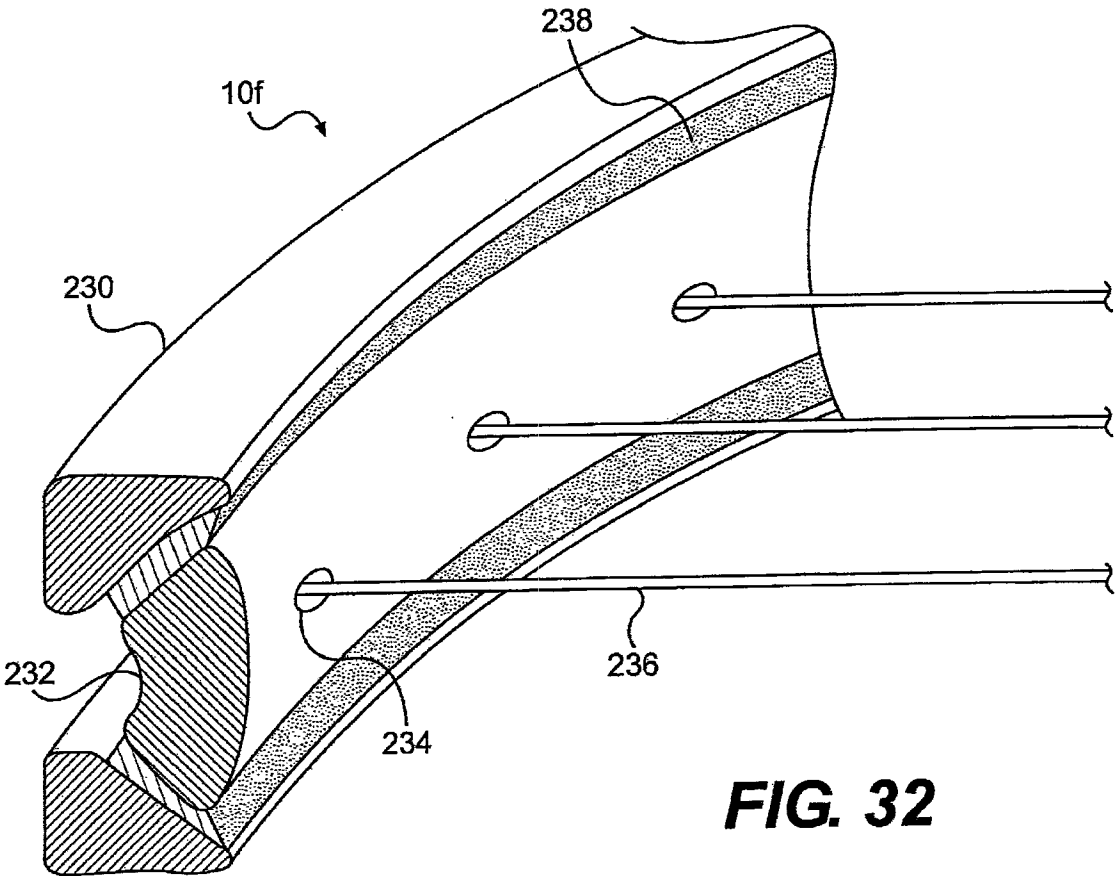
FIG. 32 is a partial section view of a racket according to yet another aspect of the present disclosure.
Figure 33:
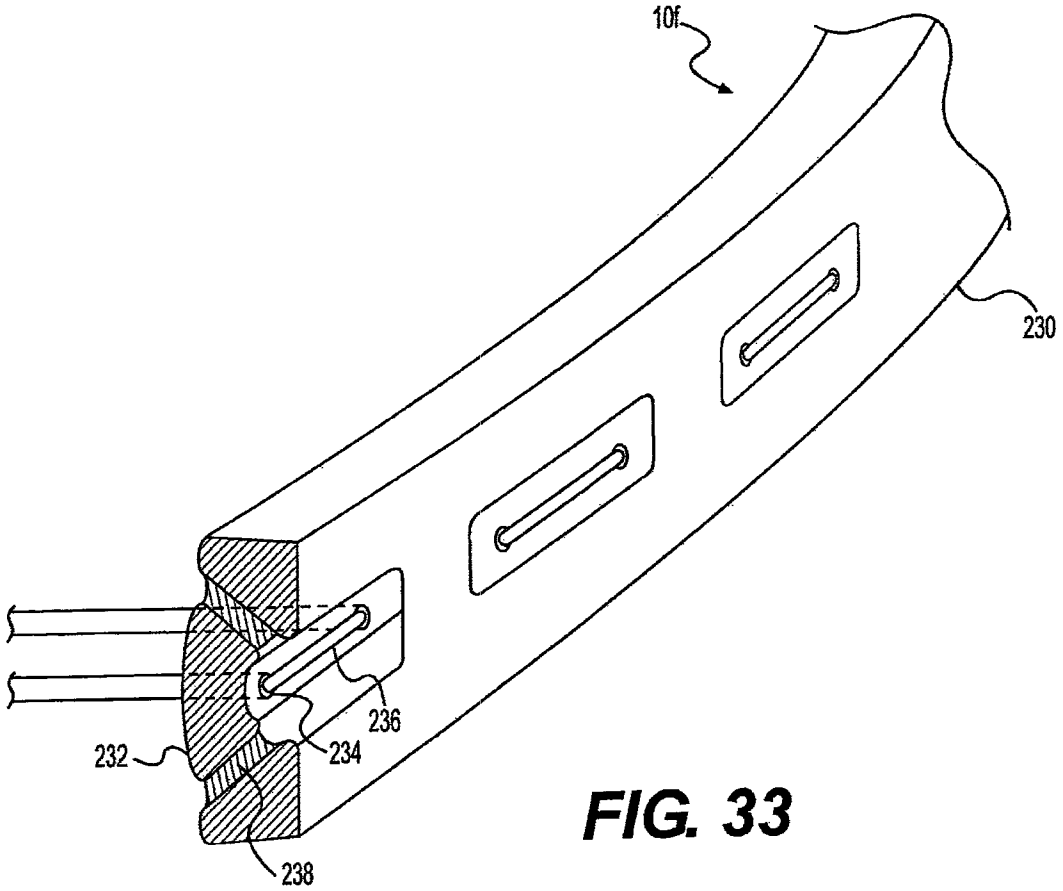
FIG. 33 is another partial section view of the racket of FIG. 32 according to yet another aspect of the present disclosure.

Racket 10*f* is shown in FIGS. 32 and 33. Racket 10*f* may include a frame assembly including an outer frame 230 and an inner frame 232. A string hole 234 for a string 236 is shown extending through inner frame 233, which may provide support for all other strings as well. Shear thickening materials 238 may be provided between outer and inner frames. 230 and 232, to connect outer and inner frames 230 and 232. Shear thickening materials 238 may include, for example, a shear thickening composite including a dilatant foam. Shear thickening materials 238 may be bounded to outer and inner frames 230 and 232 by adhesive, mechanical connection, encapsulation, and/or any other means known in the art.

With the construction of racket 10*f*, outer frame 230 and inner frame 232 may be isolated from one another. By selecting shear thickening materials having different stiffening characteristics, for use as shear thickening material 238, the playability of racket 10*f* may be adjusted. It is also contemplated that different shear thickening materials may be used in different regions of the gap between outer and inner frames 230 and 232, providing a way to further adjust the playability of racket 10*f*. The surfaces of outer and inner frames 230 and 232 that face each other may be shaped such that the gap formed between outer and inner frames 230 and 232 may not be straight. For example, the surfaces of outer and inner frames 230 and 232 may include substantially complementary curvatures.

When no force, or a small force acts on string 236 or any other string, the small force may produce little or no movement between outer and inner frames 230 and 232. As such, shear thickening materials 238 may remain soft, allowing outer and inner frames 230 and 232 to move relative to one another. The relative movement may include a rotational component, with outer frame 230 rotating towards inner frame 232, or vice versa. It should be understood that shear movement between the outer and inner frames 230 and 232 may also occur.

On the other hand, when a large force acts on string 236, the large force may initiate increased movement between outer and inner frames 230 and 232, which may in turn generate forces on shear thickening materials 238 due to the bonding between shear thickening materials 238 and outer and inner frames 230 and 232. This may cause shear thickening materials 238 to stiffen. When shear thickening materials 238 stiffen, shear movement or relative rotation of one of outer and inner frames 230 and 232 relative to the other of outer and inner frames 230 and 232 may be reduced or impeded. Because shear thickening materials 238 can selectively adjust the stiffness of racket 10*f* (by becoming more or less stiff), the playability of racket 10*f* may be adjusted in the manner described with respect to racket 10*e*. Thus, racket 10*f* may be able to provide a softer feel for touch shots, and a harder feel for power shots.

Figure 34:
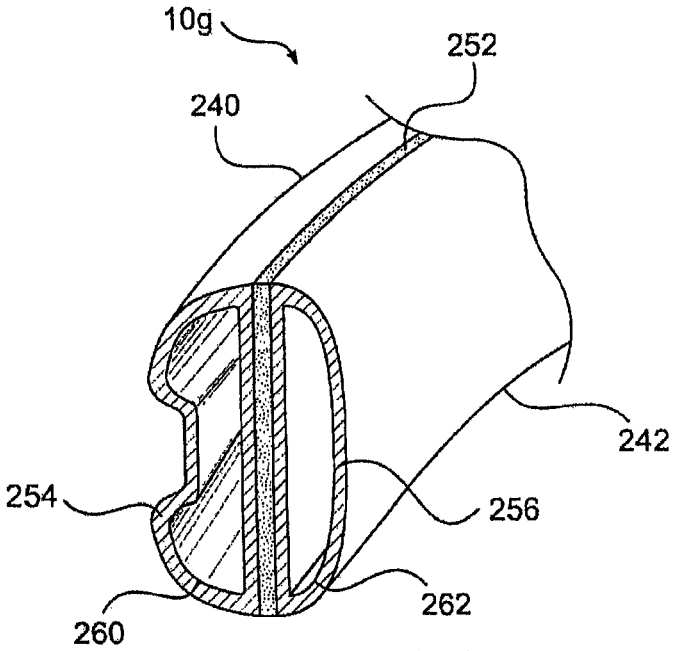
FIG. 34 is a partial section view of a racket according to yet another aspect of the present disclosure.
Figure 35:
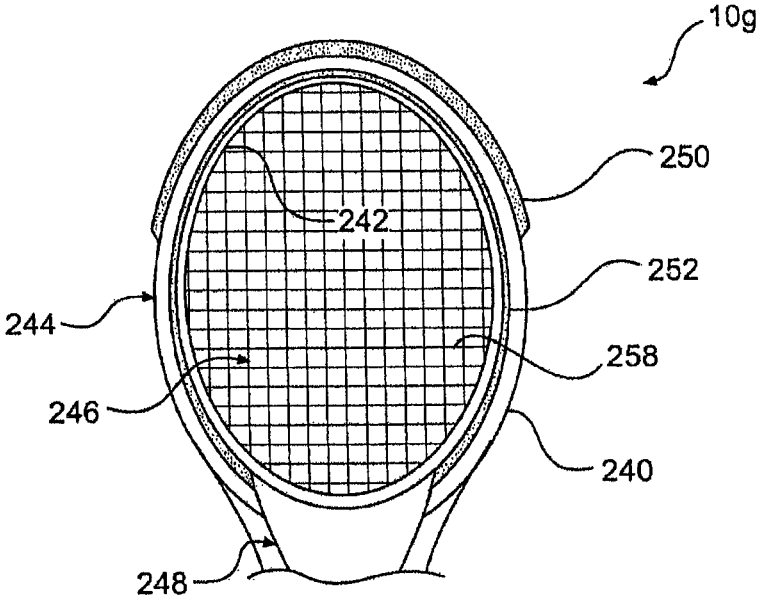
FIG. 35 is a partial front view of the racket of FIG. 34 according to yet another aspect of the present disclosure.

Racket 10*g* is shown in FIGS. 34 and 35. Racket 10*g* may include a frame assembly including an outer frame 240 formed by a wall 254 that may surround a central passage 260, an inner frame 242 formed by a wall 256 that may surround a central passage 262, and shear thickening materials 252. Shear thickening materials 252 may connect outer and inner frames 240 and 242. Shear thickening materials 252 may include, for example, a shear thickening composite including a dilatant foam. Shear thickening materials 252 may be bounded to outer and inner frames 240 and 242 by adhesive, mechanical connection, encapsulation, and/or any other means known in the art.

FIG. 35 shows a front view of racket 10*g*, including a head region 244, a striking region 246 including a string bed with a string 258, a throat region 248, and a bumperguard 250. With the construction of racket 10*g*, outer frame 240 and inner frame 242 may be isolated from one another. By selecting shear thickening materials having different stiffening characteristics, for use as shear thickening material 252, the playability of racket 10*g* may be adjusted. It is also contemplated that different shear thickening materials may be used in different regions of the gap between outer and inner frames 240 and 242, providing a way to further adjust the playability of racket 10*g*.

When no force, or a small force acts on string 258 or any other string in the string bed, the small force may produce little or no movement between outer and inner frames 240 and 242. As such, shear thickening materials 252 may remain soft, allowing outer and inner frames 240 and 242 to move relative to one another. The relative movement may include a rotational component, with outer frame 240 rotating towards inner frame 242, or vice versa. It should be understood that shear movement between the outer and inner frames 240 and 242 may also occur.

On the other hand, when a large force acts on string 258 or any other string in the string bed, the force may initiate relative movement between outer and inner frames 240 and 242, which may in turn generate forces on shear thickening materials 252 due to the bonding between shear thickening materials 252 and outer and inner frames 240 and 242. This may cause shear thickening materials 252 to stiffen. When shear thickening materials 252 stiffen, shear movement or relative rotation of one of outer and inner frames 240 and 242 relative to the other of outer and inner frames 240 and 242 may be reduced or impeded. Because shear thickening materials 252 can selectively adjust the stiffness of racket 10*g* (by becoming more or less stiff), the playability of racket 10*g* may be adjusted in the manner described with respect to rackets 10*e* and 10*f*. Thus, racket 10*g* may be able to provide a softer feel for touch shots, and a harder feel for power shots.

Figure 38:
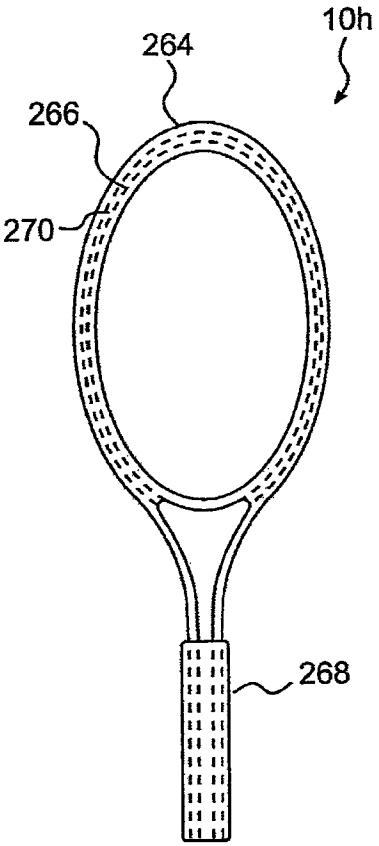
FIG. 38 is a front view of a racket including the racket frame of FIG. 36 according to yet another aspect of the present disclosure.
Figure 37:
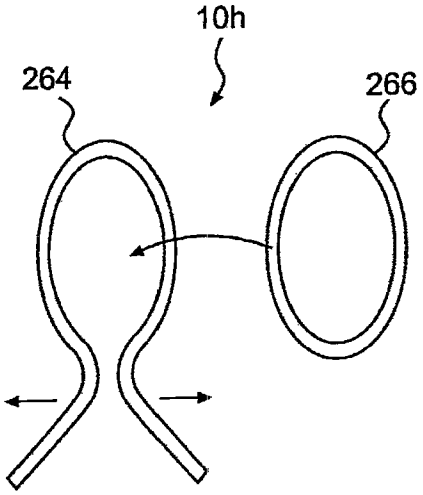
FIG. 37 is another front view of the racket frame of FIG. 36 according to yet another aspect of the present disclosure.
Figure 36:
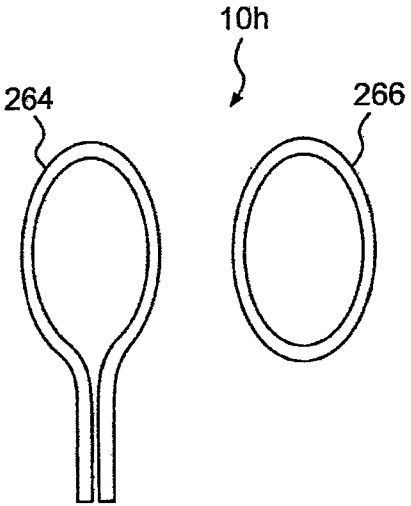
FIG. 36 is a front view of a racket frame according to yet another aspect of the present disclosure.

FIGS. 36-38 show various stages during the construction of racket 10*h*. Racket 10*h* may include an outer frame 264, an inner frame 266, a grip 268, and shear thickening materials 270. It should be understood that the steps shown with respect to racket 10*h* may be the same as, or similar to, the steps used to construct rackets 10*f* and 10*g*.

As shown in FIG. 36, outer frame 264 and inner frame 266 may be separate components. Outer frame 264 may be pulled or stretched open, after which inner frame 266 may be placed within outer frame 264. It is contemplated that the connection between outer and inner frames 264 and 266 may include a snap-fit type connection. Shear thickening materials 270 may be forced into a gap between outer and inner frames 264 and 266. Additionally or alternatively, shear thickening materials 270 may be fitted in between outer and inner frames 264 and 266 as inner frame 266 is snap-fit into outer frame 264. It is also contemplated that shear thickening materials 270 may be bonded to at least one of outer and inner frames 264 and 266 while they are still separate from each other.

Once inner frame 266 has been snap-fit into outer frame 264, grip 268 may be coupled to the lower portions of outer frame 264 to secure those portions from opening again. This may provide additional securing for maintaining inner frame 266 within outer frame 264.

Shear thickening materials may also be incorporated into portions of rackets not specifically described above, as well as in any suitable portions of rackets described in PCT/EP2007/00929, and U.S. Pat. Nos. 7,077,767 B2 and 7,140,984 B2, the disclosures of all of which have been incorporated herein by reference.

Figure 21:
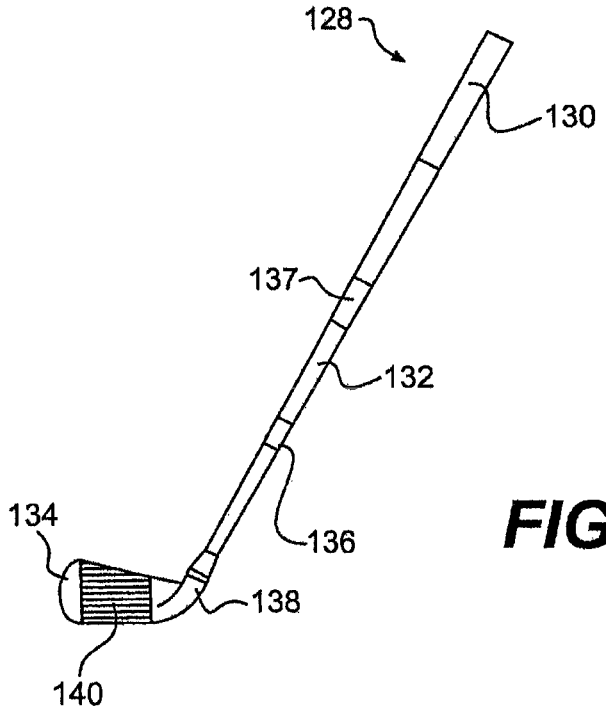
FIG. 21 is a front view of a golf club according to yet another aspect of the present disclosure.
Figure 22:
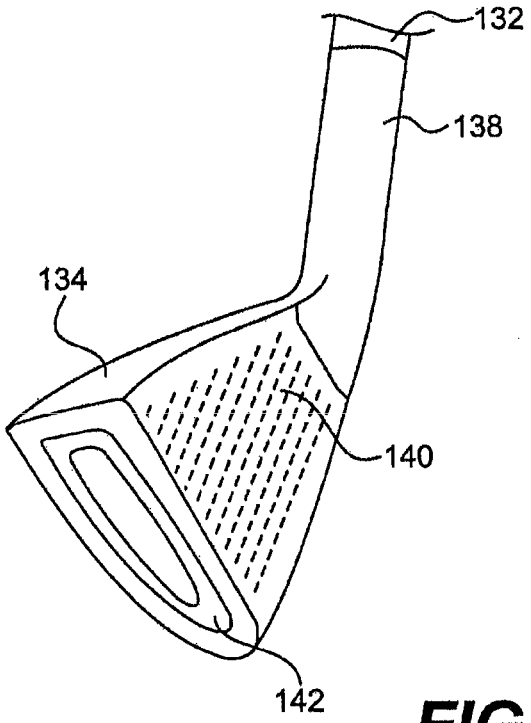
FIG. 22 is a partial section view of the golf club of FIG. 21 according to yet another aspect of the present disclosure.

Golf clubs, such as exemplary golf club 128 shown in FIGS. 21 and 22, may include shear thickening materials. The following description of golf club 128 may be equally applicable to, drivers, wedges, irons, woods, putters, and/or any other type of golf club known to those skilled in the art.

Golf club 128 may include a handle 130, a shaft 132, and a head 134. The construction of handle 130 may be similar to that described above with respect to handle region 30, in that handle 130 may include a portion of shaft 132, a grip, and/or grip tape. Shaft 132, the grip, and/or the grip tape may include shear thickening materials, much like handle region 30, grip 100, and/or grip tape 106 of FIGS. 11-14.

Shaft 132 may include a tubular body made of metal or composite material, such as a carbon fiber composite. Shaft 132 may be designed to have a degree of flex. Shaft flex is the amount that shaft 132 will bend when placed under a load. A stiffer shaft will not flex as much, and as a result, a user must generate more power in order to strike a golf ball properly. A user may be able to strike a golf ball properly with less power using a flexible shaft, but accuracy may suffer since the bending may result in the misalignment of head 134. Thus, manufacturers of golf clubs may make shafts with a variety of flexes to accommodate the different needs of users.

Composite material 18 shown in FIG. 1 may be used in the construction of shaft 132. In addition, other materials, including shear thickening materials used in the construction of frame 16, may also be used in similar ways in the construction of shaft 132. Shear thickening materials may also be included in a portion of shaft 132 corresponding to a flexpoint 136. Flexpoint 136 may be found where shaft 132 experiences deformation and/or stress when golf club 128 is swung.

Additionally or alternatively, shear thickening materials may be included in a portion of shaft 132 corresponding to an antinode 137. Antinode 137 may include a region of shaft 132 experiencing maximum vibrational displacement when golf club 128 strikes a golf ball. Alternatively, shear thickening materials may be used along the entire longitudinal length of shaft 132.

A hosel 138 may attach head 134 to shaft 132. Head 134 may include at least one hitting surface 140. Head 134 may be constructed of one or more layers of material, as shown in FIG. 22. One or more of those layers, such as a layer 142, may include shear thickening materials.

Figure 23:
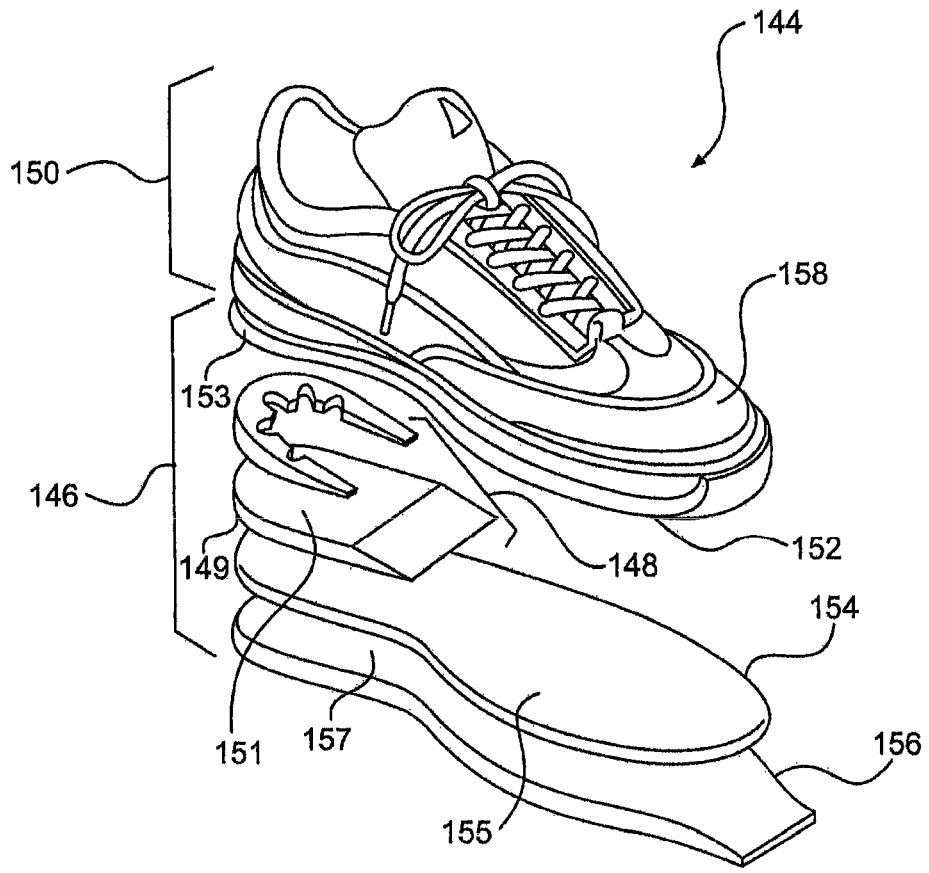
FIG. 23 is an exploded perspective view of a shoe according to yet another aspect of the present disclosure.

Footwear, such as a shoe. 144 shown in FIG. 23, may include shear thickening materials. While only shoe 144 is described here, the description of shoe 144 may be equally applicable to tennis shoes, indoor sport shoes, golf shoes, sneakers, running shoes, trekking shoes, hiking shoes, multifunction shoes, walking shoes, sandals, ski boots, and snowboard boots.

Parts of shoe 144 may include, for example, a sole 146, a heel 148, an upper 150, and/or any other elements known to those skilled in the art. Sole 146 may include an insole 152, a midsole 154, and an outsole 156. The front half of shoe 144 will be referred to as the forefoot area, while the rear half of shoe 144 will be referred to as the heel area.

Insole 152 may include the interior bottom of shoe 144 sitting directly beneath a wearer's foot. Insole 152 may be fixed or removable. Removability allows insole 152 to be replaced or added for comfort or health reasons. Insole 152 may be at least partially constructed of one or more shear thickening materials. For example, shear thickening materials 153 may be found in the forefoot area of insole 152, the heel area of insole 152, or along the entire length of insole 152.

Outsole 156 may include a portion of sole 146 in direct contact with the ground. Outsole 156 may include a tread design configured to enhance traction with the ground. Outsole 156 may be at least partially constructed of shear thickening materials. For example, shear thickening materials 155 may be found in the forefoot area of outsole 156, the heel area of outsole 156, or along the entire length of outsole 156.

Midsole 154 may include the layer in between outsole 156 and insole 152, and may be designed to absorb shock. Midsole 154 may be at least partially constructed of shear thickening materials. For example, shear thickening materials 157 may be found in the forefoot area of midsole 154, the heel area of midsole 154, or along the entire length of midsole 154.

Heel 148 may be configured to support the heel of a wearer's foot. Heel 148 may be at least partially constructed of shear thickening materials. For example, a heel part 149 may include shear thickening materials 151. Additionally or alternatively, heel 148 may include one or more spaces designed to receive shear thickening materials.

Upper 150 may include those portions of shoe 144 above sole 146. Upper 150 may include, for example, woven material. The woven material may include shear thickening materials. The woven material may be composed of a plurality of panels. One or more of those panels, such as panel 158, may include shear thickening materials. It is also contemplated that different panels may include different shear thickening materials.

Figure 24:
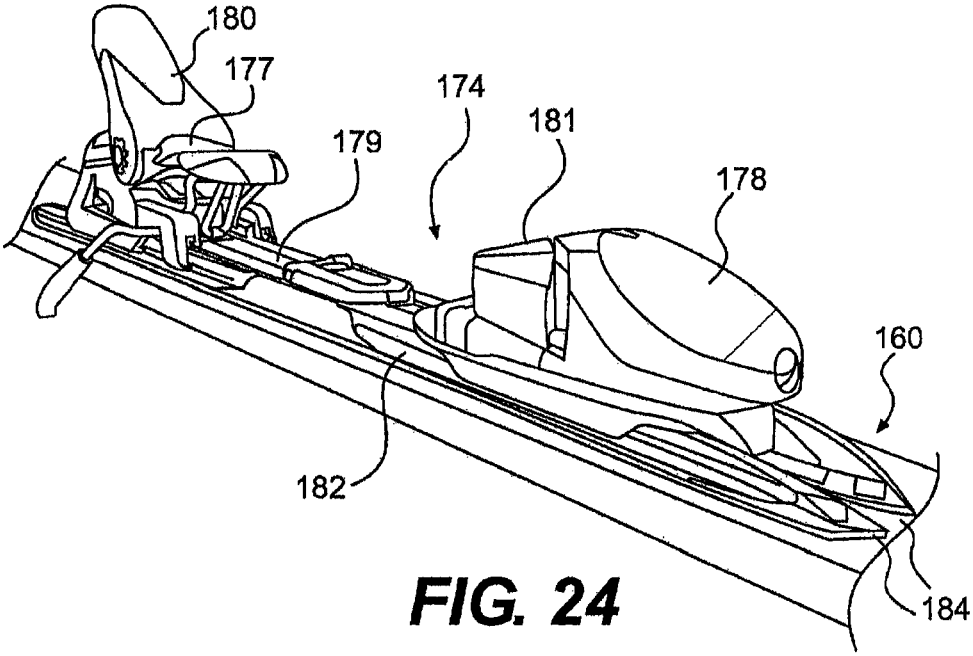
FIG. 24 is a partial perspective view of a ski according to yet another aspect of the present disclosure.
Figure 25:
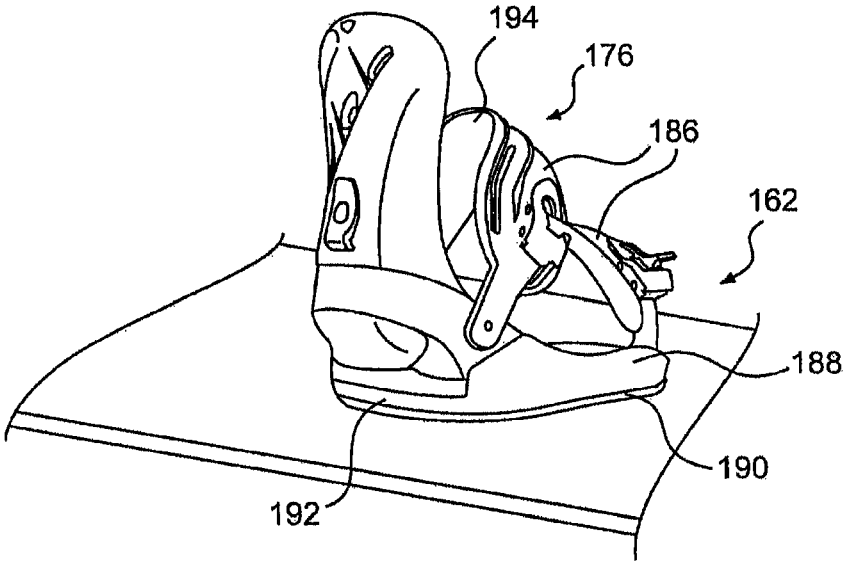
FIG. 25 is a partial perspective view of a snowboard according to yet another aspect of the present disclosure.
Figure 26:
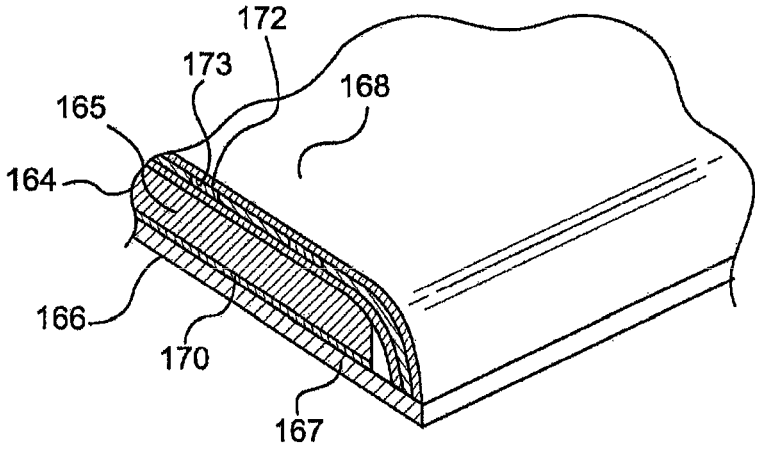
FIG. 26 is a partial section view of the ski of FIG. 24 and/or the snowboard of FIG. 25 according to yet another aspect of the present disclosure.

Snow sports products, such as ski 160 and snowboard 162 of FIGS. 24-26, respectively, may include shear thickening materials. A cross section representative of both skis and snowboards is shown in FIG. 26. The cross section depicts an intermediate layer, or core 164. Core 164 may be constructed of laminated fiberglass, wood, aluminum, composite honeycomb, foam, and/or resin. The laminated fiberglass may include one or more fibers, such as, for example, carbon fibers, aramid fibers, and/or any other suitable reinforcing fibers known in the art. The fibers may run parallel to the longitudinal axis of core 164 and/or at an angle with the longitudinal axis of core 164. Core 164 may also include shear thickening materials 165. For example, shear thickening materials 165 may include impregnated fibers in the fiber glass, impregnated laminated fiberglass, inserts or fillers in gaps in composite honeycomb, foam, and/or resin mixed with shear thickening material. It is also contemplated that core 164 may be made of composite material 18.

The cross section also depicts a base 166. Base 166 may be in contact with the snow surface when ski 160 or snowboard 162 is in use. Base 166 may be constructed of a porous, plastic material that may be saturated with a wax to create a very quick and smooth surface. Base 166 may also include shear thickening materials. For example, shear thickening material 167 may be mixed in with the porous, plastic material used to form base 166.

The cross section also depicts a laminate 168 surrounding core 164. Laminate 168 may include one or more layers of fiber reinforced material, such as fiberglass. The fiber reinforced material may be similar to composite material 18 of FIG. 1. Laminate 168 may include one or more interruptions or gaps 172 for receiving shear thickening materials 173. A shear thickening layer 170 may also be provided. Shear thickening layer 170 may be impregnated with one or more shear thickening materials, or may be mixed with shear thickening materials.

The shear thickening materials may extend along the entire lengths of ski 160 and snowboard 162. Or, the shear thickening materials may be used in specific regions along the lengths of ski 160 and snowboard 162, such as in regions experiencing shear stress and/or bending stress, such as beneath bindings 174 and 176. Preferably, the shear thickening materials may be used in regions experiencing maximum shear stress and/or bending stress. Additionally or alternatively, shear thickening materials may be placed at antinodes, where ski 160 and snowboard 162 may experience maximum vibration displacement after an impact.

Bindings 174 and 176 may be configured to bind or hold a user's boot (not shown) on ski 160 or snowboard 162. Binding 174 may include a toe grip 178, a heel grip 180, and a plate 182. Shear thickening materials may be provided in toe grip 178, heel grip 180, and/or plate 182. A shear thickening layer 184 may be provided between toe grip 178, heel grip 180, and/or plate 182, and the top surface of ski 160. Shear thickening materials 177, 179, and 181 may also be provided where a user's boot (not shown) contacts toe grip 178, heel grip 180, and/or plate 182.

Binding 176 may include grips 186 and a plate 188. Shear thickening materials may be provided in grips 186 and/or plate 188. A shear thickening layer 190 may be provided between plate 188 and the top surface of snowboard 162. Layers 192 and 194 of shear thickening material may also be provided between plate 188 and a user's boot (not shown), and/or between grips 186 and a user's boot.

Shear thickening materials may be used in the construction of personal protection equipment. Personal protection equipment may include, for example, helmets, shoulder pads, torso protectors, cups, hand pads, arm pads, hip pads, tail pads, mouth guards, neck rolls, thigh pads, knee pads, shin guards, and foot pads, and/or any other personal protective equipment known to those skilled in the art. A helmet 196, a torso protector 198, and a lower body protector 200 will be described below, however, it should be understood that the descriptions below may be equally applicable to other forms of personal protection equipment.

Figure 27:
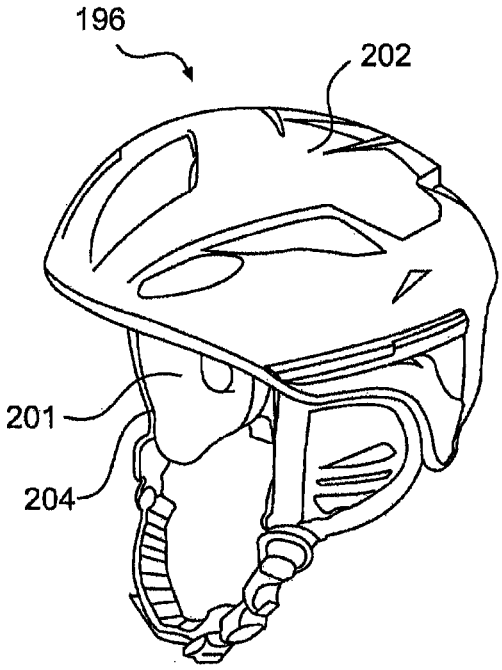
FIG. 27 is a perspective view of a helmet according to yet another aspect of the present disclosure.

Helmet 196, shown in FIG. 27, may be configured to help protect a wearer's head from impacts by absorbing the impact, and/or distributing impacts to a different or larger surface area. It may be desirable for helmet 196 to absorb impacts without being excessively bulky or heavy, since higher volume and weight may increase the injury risk for the wearer's neck, and may unduly restrict movement. Helmet 196 may include a shell 202, as well as padding 204 inside shell 202. Shell 202 may be made of relatively hard or stiff polymeric materials and/or materials reinforced by fibers, such as aramid fibers. Shear thickening materials may be mixed in with the polymeric material, used to impregnate the reinforcing fibers, and/or used to impregnate the medium containing those fibers. For example, shell 202 may be made of composite material 18.

Padding 204 may line the inside surface of shell 202. Padding 204 may include one or more pads made of relatively soft or flexible material. Those materials may include shear thickening materials 201. Different regions of padding 204 may include different shear thickening materials. For example, the regions of padding 204 contacting the upper portion of a wearer's head may include shear thickening materials having a higher viscosity or more rigidity than shear thickening materials included in the regions of padding 204 contacting the lower portion of a wearer's head.

Figure 28:
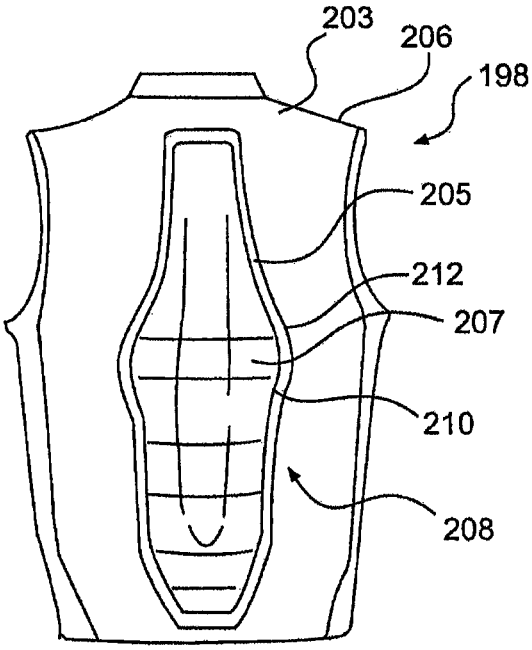
FIG. 28 is a perspective view of a torso protector according to yet another aspect of the present disclosure.

Torso protector 198, shown in FIG. 28, may be configured to help protect a wearer's torso from impacts by absorbing the impacts, and/or distributing the impacts to a different or larger surface area. Torso protector 198 may include, for example, a woven material 206. Woven material 206 may include shear thickening materials 203. Woven material 206 may support one or more articles, such as covering 208, over sensitive or easily injured parts of a wearer's torso (e.g., over a wearer's spine). Covering 208 may also include shear thickening materials. For example, covering 208 may include a relatively hard outer shell 210 with a relatively soft pad 212 underneath the outer shell (similar to the arrangement in helmet 196). Outer shell 210 may be made of polymeric materials and/or materials reinforced by fibers, such as aramid fibers. Shear thickening materials 207 may be included in outer shell's construction. Pad 212, like padding 204, may be made of, or may otherwise include, shear thickening materials 205.

Figure 29:
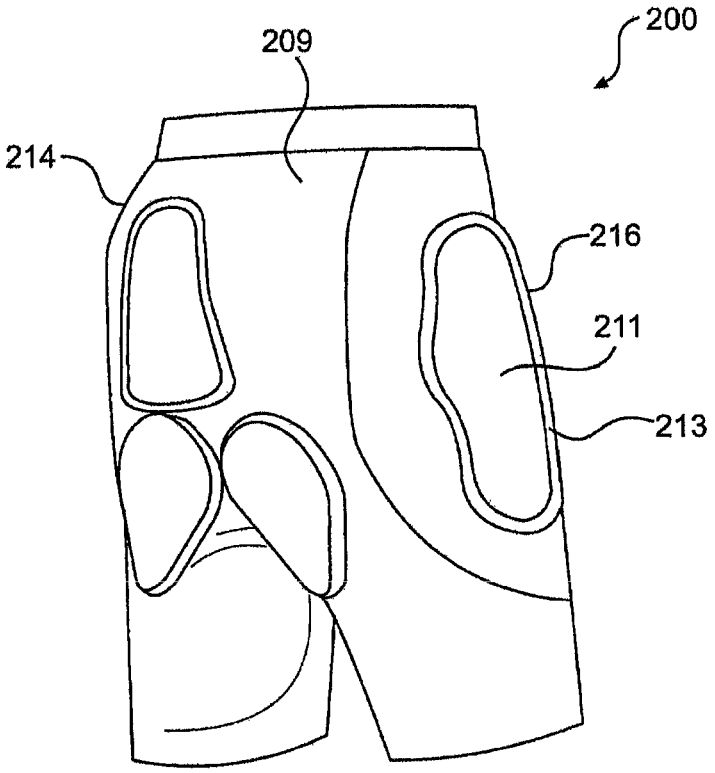
FIG. 29 is a perspective view of a lower body protector according to yet another aspect of the present disclosure.

Lower body protector 200, shown in FIG. 29, may be configured to help protect a wearer's lower body from impacts by absorbing the impacts, and/or distributing the impacts to a different or larger surface area. The construction of lower body protector 200 may be similar to the construction of torso protector 198. For example, lower body protector may include a woven material 214 and a covering 216. One or both of those elements may include shear thickening materials, including, for example, shear thickening materials 209, 211, and 213.

With respect to each of the above descriptions of sports products, all of the components in the sports product that include shear thickening materials may include the same types of shear thickening materials. Alternatively, the components each may include a different type of shear thickening material. It is also contemplated that a component that includes a shear thickening material may include only one version of the shear thickening material. Alternatively, the component may include more than one version of the shear thickening material. For example, a component may include a shear thickening material having ingredients in amounts fitting a first ratio in a first region, and may include a shear thickening material having the same ingredients in amounts fitting a second ratio, different from the first ratio, in a second region. Thus, the shear thickening behavior of the component may vary between its regions. It is also contemplated that the component may include two or more entirely different types of shear thickening material. One type of shear thickening material may exhibit shear thickening behavior upon experiencing a first type of force, while another type of shear thickening material may exhibit shear thickening behavior upon experiencing a second type of force.

INDUSTRIAL APPLICABILITY

Sports products that include shear thickening materials in their construction may be enhanced in terms of their performance, wear resistance, and user comfort. Some of the enhancements are discussed below.

Using shear thickening materials in a racket, such as those shown in FIGS. 1-14, 17-20, and 30-38, may provide a number of benefits. One benefit has to do with impact absorption. During play, a user may strike a racket against the ground, a wall, or some other object. Shear thickening materials in a racket's frame and/or bumperguard can help absorb the impacts. For example, when a bumperguard that includes shear thickening material impacts an object, the shear thickening material may stiffen, and thus, the bumperguard may become harder. The increased hardness may help protect the other portions of the racket from being damaged by the impact. Moreover, when the bumperguard becomes harder, it may become more resistant to wear caused by, for example, a scraping impact with the ground. Yet the bumperguard may maintain its malleability in the absence of an impact, allowing for easy mounting of the bumperguard on the racket. Thus, the bumperguard may be capable of absorbing impacts like a harder material, while also being easy to mount like a more flexible material.

Shear thickening materials may provide similar benefits when used in other parts of a racket. For example, shear thickening materials in a racket's frame may serve to harden the frame during impacts. The increased hardness of the frame may help protect the racket from wear or other damage caused by the impact. Shear thickening materials may also harden a racket's strings during impacts, which may help protect the strings from wear or other damage, especially at points where one string is in contact with another.

Another benefit that shear thickening materials may provide is vibration dampening. When a racket is used to strike a ball, or any other object, the impact may create vibrations. Without some mechanism for dampening the vibrations, the vibrations may be transmitted through the racket to the user's arm. Dampening those vibrations before they reach the user's arm may improve the "feel" of the racket. Using shear thickening materials in the construction of the racket may help dampen the vibrations. For example, the vibrations may originate in the area of impact. When the vibrations encounter the shear thickening materials in the racket (whether in the strings, frame, grip, or some other part), they may agitate the shear thickening materials as they attempt to pass, causing the shear thickening materials to become increasingly viscous or rigid. As the shear thickening materials become more viscous or rigid, it may become more and more difficult for the vibrations to pass. Thus, the shear thickening materials may create an energy absorbing barrier between the point of impact and the user's arm.

Another benefit has to do with adaptability. Different users may prefer different degrees of racket flexibility. One user may prefer a flexible racket because it may provide that user with greater control over the ball. Another user may prefer a stiff racket because it may provide that user with the ability to strike the ball harder. Yet another user may prefer a flexible racket under one set of circumstances, and a stiff racket under other circumstances. By using shear thickening materials in the construction of a racket, particularly in the racket's frame and/or strings, the racket may be adaptable, in that it may provide the benefits of both a flexible racket and a stiff racket in a single package.

For example, a flexible racket may be helpful to a user who is attempting to make a shot that requires touch or control. Touch shots typically involve low intensity impacts, or impacts that occur over a long timescale. Shear thickening materials in the racket may remain fluid or flexible during such impacts, and thus, the racket itself may remain flexible, helping the player execute the touch shot. On the other hand, a stiff racket may be helpful to a user who is attempting to make a shot that requires power. Power shots typically involve high intensity impacts, or impacts that occur over a short timescale. The shear thickening materials in the racket may stiffen during such impacts, and thus, the racket itself may stiffen, helping the player execute the power shot. Accordingly, a single racket can provide a user with the benefits of both a flexible racket and a stiff racket.

Additionally, shear thickening materials in a grip or handle area of a racket may remain flexible, and thus, deformable, during periods of play between impacts. Thus, the grip may easily conform to a user's hand, which may also improve the racket's "feel." When the racket impacts an object, the shear thickening materials, and the grip itself, may become more viscous or rigid, giving the user greater control over the racket, while also dampening vibrations.

As another example, a user that is a beginner may prefer a more flexible racket, since it may provide the user with greater power. However, as the user's game and power improve, the user may prefer a stiffer racket that may provide the user with greater accuracy. In the past, the user would purchase one racket as a beginner, and another stiffer racket at a more advanced level. However, by using shear thickening materials, that single racket may be adequate at both skill levels. For example, a racket may include shear thickening materials that may remain flexible when exposed to forces generated by a beginner, which are typically lower than those generated by an advanced player. The shear thickening materials may stiffen when exposed to forces generated by an advanced player, and thus, the racket may be stiffer for the advanced player.

Using shear thickening materials in a golf club, such as that shown in FIGS. 21 and 22, may provide a number of benefits. One benefit has to do with shear resistance and durability. The hardening of the shear thickening materials may help to protect a golf club from wear or damage at its hitting surface resulting from repeated strikes against golf balls during play. The hardening may also help protect the golf club from errant strikes against other objects, including the ground.

Another benefit the shear thickening materials may provide is vibration dampening. When a golf club strikes a golf ball, the impact creates vibrations, originating at a hitting surface of the golf club's head. Without some mechanism for dampening those vibrations, they may continue up a shaft of the golf club, into a handle or grip, and then into a user's arm. Providing shear thickening materials in the golf club, whether it be in the head, shaft, or grip, may help dampen the vibrations in a manner similar to that described above with respect to a racket. This may help improve the overall "feel" of the club, as experienced by its user.

Shear thickening materials may be used to make a golf club adaptable, giving the golf club different characteristics under different circumstances. It is known that different users may prefer different degrees of flexibility for their golf clubs. One user may prefer a more flexible golf club because it may provide that user with more power (due at least in part to the ability to store energy in a flexed shaft). Another user may prefer a stiffer golf club because it may provide that user with greater accuracy (due at least in part to less club movement during a stroke). Yet another user may prefer a more flexible club under one set of circumstances, and a stiffer club under other circumstances. By using shear thickening materials in a golf club, the golf club may be capable of providing the benefits of both flexible and stiff clubs.

For example, flexibility may be desirable in a shaft of a golf club during the backswing and downswing phases of a stroke. Shaft flex may load the shaft with energy, allowing the user to strike a golf ball with greater power. However, stiffness in the shaft may be desirable upon making contact with the ball, to prevent the impact from causing the club's head from becoming misaligned. By using shear thickening materials in the club's shaft, the shaft may have the desired flexibility during the backswing and downswing, as well as the desired stiffness at impact with the ball.

Additionally or alternatively, flexibility may be desirable in the club's hitting surface. For example, for short shots that may require greater control, keeping the hitting surface flexible may help provide that control. On the other hand, for long shots requiring greater power, keeping the hitting surface stiff may help to transmit as much power as possible from the club to the ball. Since short shots may typically be lower impact than long shots, the shear thickening materials in the hitting surface may remain flexible, giving the user greater control. On the other hand, the impacts associated with long shots may cause the shear thickening materials to stiffen, and thus, the hitting surface itself may also become stiffer. Accordingly, by using shear thickening materials in the construction of the hitting surface, both control and power may be achieved.

As another example, a user that is a beginner may prefer more flexible clubs, since they may provide the user with greater power. However, as the user's game and ability to generate power improve, the user may prefer stiffer clubs that provide the user with greater accuracy. In the past, the user would purchase more flexible clubs at the beginner level, and then stiffer clubs at a more advanced level. However, by using shear thickening materials, a single set of clubs may be adequate at both skill levels. For example, clubs may include shear thickening materials that may remain flexible when exposed to forces generated by a beginner, which are typically lower than those generated by an advanced player. Thus, the clubs may be flexible enough for the beginner. The shear thickening materials may stiffen when exposed to forces generated by an advanced player, and thus, the clubs may also be stiff enough for the advanced player.

Using shear thickening materials in footwear, such as that shown in FIG. 23, may provide a number of benefits. Among those benefits is impact absorption. Shear thickening materials in a shoe's sole may become more viscous or rigid upon experiencing an impact against the ground, or a sharp object, helping to protect a wearer's foot from the impact. Shear thickening materials in a shoe's upper may become more rigid on impact, helping to provide additional support to the wearer's foot and ankle. The increased rigidity may also help protect the shoe from wear or other damage caused by impacts, increasing the shoe's useful life. The shear thickening materials may also dampen vibrations caused by the impacts, similar to the way vibrations may be dampened in a racket.

Using shear thickening materials in skis or snowboards, such as those shown in FIGS. 24-26, may provide them with a number of benefits. While the following discussion focuses primarily on skis, it should be understood that the aspects described are also applicable to snowboards.

A ski's ability to bend or flex as it carries a user is an important performance features. The flexing and counter-flexing of the ski may help keep the user in control. The user, by shifting his or her weight, bending, and/or twisting, may manipulate the ski as the user goes over the contours of a slope. If snow conditions remain constant, a single type of ski with one flex profile could possibly be adequate. However, snow conditions may vary widely, even on a single slope. When the snow is hard, the user may desire a degree of rigidity in the ski. The rigidity may help the user dig the edges of the ski into the hard snow to make a turn. When the snow is soft, the user may desire a degree of flexibility in the ski. The flexibility may help the user bend the ski to make a turn. By using shear thickening materials in the construction of the ski, the ski may behave desirably in both conditions. For example, on hard snow, where impacts against the ski may be sudden and/or of a high magnitude, the shear thickening materials may become more viscous or rigid, giving to the ski the stiffness desired by the user. On the other hand, on soft snow, where impacts against the ski may occur over a long timescale, and/or may be of a low magnitude, the shear thickening materials may remain more fluid or flexible, giving the ski the flexibility desired by the user.

Shear thickening materials may also be helpful in the construction of a ski's binding. A loose attachment between a user's boot and the binding may result in less energy transfer from the ski to the user when the ski encounters obstacles on a slope. This may result in higher speeds, which may be important in sports, such as racing. However, the same loose attachment may result in a loss of ski control in turns. Accordingly, it may be desirable to have a loosely attached ski when traveling in a substantially straight line, for greater speed, and a tightly attached ski when making turns, for more control. By using shear thickening materials in the binding, or between the binding and the ski, the benefits of loose attachment and tight attachment may be achieved. For example, during substantially straight line travel, where shear forces on the ski, binding, and the user's boot may be low, shear thickening materials associated with the binding may remain fluid or flexible, giving the loose attachment the user desires. When turning, the shear forces on the ski, binding, and the user's boot may increase. Accordingly, the shear thickening materials associated with the binding may become more viscous or rigid, giving the tight attachment the user desires.

Shear thickening materials may also help to reduce vibration in a ski. As a user goes along the contours of a slope, variations in the contours may impact against the ski, causing vibrations. The vibrations may develop into an audible or perceptible chatter. Incorporating shear thickening materials into the ski, binding, and/or user's boot may help to absorb the chatter in a manner similar to that described above with respect to a racket.

Using shear thickening materials in personal protection equipment, such as those shown in FIGS. 27-29, may provide them with a number of benefits. For most types of personal protection equipment, impact absorption may be a critical function. The equipment should be capable of protecting a user from impacts the user experiences while playing a sport. At the same time, if the equipment is too heavy, bulky, or uncomfortable, the user's performance may suffer. By using shear thickening materials, these considerations can be balanced. A piece of equipment constructed using shear thickening materials may become more viscous or rigid upon impact, due to the shear thickening behavior of the shear thickening materials in the presence of a shearing force. The hardening may allow the piece of equipment to protect covered areas of the user's body. Absent an impact, the shear thickening materials, and thus the piece of equipment itself, may retain a degree of fluidity or flexibility, providing the user with greater comfort and freedom of movement. Additionally, fortifying a piece of equipment with shear thickening materials may increase its strength without adding excessive bulk or weight that could hinder a user's performance.

Other embodiments of the disclosure will be apparent to those skilled in the art from consideration of the specification and practice of the disclosure. It is intended that the specification and examples be considered as exemplary only, with a true scope and spirit of the disclosure being indicated by the following claims.

What is claimed is:

1. A racket, comprising:

a head region;

a striking region;

a throat region;

a shaft region;

a handle region; and a shear thickening material in the striking region, the shear thickening material being configured to exhibit shear thickening behavior when an impact occurs between the racket and an object.

2. The racket of claim 1, wherein the striking region that includes the shear thickening material includes one or more reinforcing fibers impregnated with the shear thickening material.

3. The racket of claim 1, wherein the striking region that includes the shear thickening material includes an epoxy material that includes shear thickening material.

4. The racket of claim 1, wherein the shear thickening material is in a filament in the striking region.

5. The racket of claim 1, wherein the shear thickening material is a shear thickening layer in the striking region.

6. The racket of claim 1, wherein the shear thickening material includes particles suspended in a fluid medium.

7. The racket of claim 1, wherein the striking region that includes the shear thickening material includes:

an inner layer, an outer layer at least partially surrounding the inner layer; and a layer of shear thickening material disposed at least partially between the inner layer and the outer layer, the shear thickening material being configured to selectively stiffen to control relative movement between the inner layer and the outer layer.

8. The racket of claim 1, wherein the shear thickening material is additionally present in at least one of the head region, the throat region, the shaft region, or the handle region.

9. A sports product, comprising:

a support member;

an impact region configured to impact an object, the impact region being coupled to the support member; and a shear thickening material in the impact region, the shear thickening material being configured to exhibit shear thickening behavior when an impact occurs between the impact region and the object.

10. The sports product of claim 9, wherein the impact region that includes the shear thickening material includes one or more reinforcing fibers impregnated with the shear thickening material.

11. The sports product of claim 9, wherein the impact region that includes the shear thickening material includes a solid foamed synthetic polymer.

12. The sports product of claim 11, wherein the impact region that includes the shear thickening material includes a polymer-based dilatant distributed through the solid foamed synthetic polymer.

13. The sports product of claim 9, wherein the impact region that includes the shear thickening material includes a solid closed cell foam matrix.

14. The sports product of claim 13, wherein the impact region that includes the shear thickening material includes a polymer-based dilatant distributed through the solid closed cell foam matrix.

15. The sports product of claim 9, wherein the impact region that includes the shear thickening material includes:

an inner layer, an outer layer at least partially surrounding the inner layer; and a layer of shear thickening material disposed at least partially between the inner layer and the outer layer, the shear thickening material being configured to selectively stiffen to control relative movement between the inner layer and the outer layer.

16. The sports product of claim 9, wherein the shear thickening material is additionally present in the support member.

* * * * *